US007451555B1

(12) United States Patent
Lakic

(10) Patent No.: US 7,451,555 B1
(45) **Date of Patent: *Nov. 18, 2008**

(54) METHODS OF MAKING ADJUSTABLE AIR CUSHION INSOLES AND RESULTING PRODUCTS

(76) Inventor: Nikola Lakic, 45-191 Elm St., Indio, CA (US) 92201

( * ) Notice: Subject to any disclaimer, the term of this patent is extended or adjusted under 35 U.S.C. 154(b) by 342 days.

This patent is subject to a terminal disclaimer.

(21) Appl. No.: 11/292,409

(22) Filed: Nov. 30, 2005

Related U.S. Application Data

(60) Continuation-in-part of application No. 10/703,268, filed on Nov. 7, 2003, now Pat. No. 6,976,321, said application No. 11/292,409 is a continuation-in-part of application No. 10/928,051, filed on Aug. 27, 2004, now Pat. No. 7,017,285, which is a continuation of application No. 10/326,247, filed on Dec. 20, 2002, now abandoned, which is a division of application No. 09/658,164, filed on Sep. 8, 2000, now Pat. No. 6,510, 624.

(60) Provisional application No. 60/153,256, filed on Sep. 10, 1999, provisional application No. 60/425,191, filed on Nov. 7, 2002.

(51) Int. Cl.
*A43B 13/20* (2006.01)

(52) U.S. Cl. ..... 36/29; 36/43; 36/44; 36/88

(58) Field of Classification Search ..... 36/29, 36/28, 3 R, 3 B, 43, 44, 88
See application file for complete search history.

(56) References Cited

U.S. PATENT DOCUMENTS

| | | | |
|---|---|---|---|
| 1,213,941 | A | 1/1917 | Patrick |
| 2,716,293 | A | 8/1955 | Rath |
| 3,170,250 | A | 2/1965 | Scholl |
| 3,180,039 | A | 4/1965 | Burns, Jr. |
| 4,183,156 | A | 1/1980 | Rudy |
| 4,219,945 | A | 9/1980 | Rudy |
| 4,271,606 | A | 6/1981 | Rudy |
| 4,340,626 | A | 7/1982 | Rudy |

(Continued)

FOREIGN PATENT DOCUMENTS

| | | |
|---|---|---|
| DE | 2321817 | 11/1973 |

(Continued)

*Primary Examiner*—Marie Patterson
(74) *Attorney, Agent, or Firm*—Schmeiser, Olsen & Watts LLP

(57) ABSTRACT

An inflatable inner sole for footwear has a flexible, inflatable enclosure with an inflation system that may includes an on-board air pump and a pressure relief valve. The inflatable inclosure may include a plurality of chambers that are independently adjustable by selectively adding or removing a gas from each chamber. The inflatable enclosure may also include a pressure gauge and an improved pressure relief valve sleeve with a spring seat. The inflatable enclosure may be formed with one or both of first and second sheets formed as contoured prefabricated sheets. Alternatively, the sheets may be flat sheets. A recess is formed in the sheets so that the recess extends out of a plane of intersection between the first and second sheets. The recess may be formed by causing a portion of the first and second sheets to bend out of the plane of intersection of the first and second sheets.

8 Claims, 21 Drawin Sheets

U.S. PATENT DOCUMENTS

| | | | | |
|---|---|---|---|---|
| 4,730,403 | A | 3/1988 | Walkhoff | |
| 4,817,304 | A | 4/1989 | Parker et al. | |
| 4,999,931 | A | 3/1991 | Vermeulen | |
| 5,025,575 | A | 6/1991 | Lakic | |
| 5,287,638 | A | 2/1994 | Preston | |
| 5,625,964 | A | 5/1997 | Lyden | |
| 5,753,061 | A | 5/1998 | Rudy | |
| 5,832,630 | A | 11/1998 | Potter | |
| 5,846,063 | A | 12/1998 | Lakic | |
| 6,092,310 | A | 7/2000 | Schoesler | |
| 7,017,285 | B2 * | 3/2006 | Lakic | 36/29 |

FOREIGN PATENT DOCUMENTS

| | | |
|---|---|---|
| DE | 3144207 | 5/1983 |
| GB | 357391 | 9/1931 |
| GB | 2189679 | 11/1987 |

* cited by examiner

METHODS OF MAKING ADJUSTABLE AIR CUSHION INSOLES AND RESULTING PRODUCTS

This application is a continuation-in-part of U.S. patent application Ser. No. 10/703,268 filed Nov. 7, 2003, now U.S. Pat. No. 6,976,321 entitled "ADJUSTABLE AIR CUSHION INSOLE WITH ADDITIONAL UPPER CHAMBER", which claims the priority of U.S. Provisional Patent Application Ser. No. 60/425,191 filed Nov. 7, 2002 by Nikola Lakic. This application is also a continuation-in-part of U.S. patent application Ser. No. 10/928,051 filed Aug. 27, 2004, now U.S. Pat. No. 7,017,285 entitled "INFLATABLE LINING FOR FOOTWEAR WITH PROTECTIVE AND COMFORTABLE COATINGS OR SURROUNDS", which is a continuation of U.S. patent application Ser. No. 10/326,247, filed on Dec. 20, 2002, entitled "INFLATABLE LINING FOR FOOTWEAR WITH PROTECTIVE AND COMFORTABLE COATINGS OR SURROUNDS", now abandoned, which was a divisional of U.S. patent application Ser. No. 09/658,164, filed on Sep. 8, 2000, and issued as U.S. Pat. No. 6,510,624, entitled "INFLATABLE LINING FOR FOOTWEAR WITH PROTECTIVE AND COMFORTABLE COATINGS OR SURROUNDS", which is entitled to the benefit of U.S. Provisional Application Ser. No. 60/153,256, filed on Sep. 10, 1999. The disclosures of these related applications are incorporated herein by this reference.

BACKGROUND OF THE INVENTION

1. Technical Field

This invention generally relates to an inflatable lining for footwear, and specifically to an inflatable inner sole with protective and comfortable coatings and surrounds and methods of manufacture.

2. State of the Art

Inner soles have been provided for shoes and boots which are formed of a compressible, elastic material such as cellular plastic foams, foam rubber, etc. These inner soles have provided only limited shock absorbency, resulting in little or no significant improvement in wearer comfort.

Sport socks are also available for hikers and runners which have a double layer of fabric on the undersurface of the sock in an attempt to prevent formation of blisters.

In some foot apparel, notably in ski boots, an outer shell is molded from plastic and is lined with an inner shoe. Adjustment has been made to the tightness of the outer shell and air bags have been provided across the instep region of the shoe, and elsewhere, and have been provided with an air pump to pressurize the air bags, thus forcing the foot against the sole and creating a snugness of the fit of the ski boot.

A water-filled inner sole for shoes has recently been marketed under the trade name "Walk On Water". While this is an attempt to increase wearer comfort, water is heavy, non-compressible and the inner sole cannot be adjusted for firmness, and cannot provide shock absorbency. Additionally, water is unsuited for use in freezing climates. Also, a leak will wet the inside of the footwear, and this inner sole is not breathable.

Another recently marketed innovation is that disclosed in U.S. Pat. Nos. 4,183,156; 4,340,626 and 4,817,304 in which an inflatable inner sole or sole insert is permanently inflated with halogenated hydrocarbon gases. Since it is impossible to preclude diffusion of gases through the plastic, the inflatable insert or inner sole is acknowledged to experience a rapid increase in pressure shortly after manufacture, followed by a slowly declining pressure, thus failing to provide a stable condition. The pressure of the inflatable member also can not be adjusted by the wearer for varying conditions of use and comfort.

DISCLOSURE OF THE INVENTION

None of the aforementioned prior devices provides a simple, inexpensive solution to the problems of minimal cushioning and adjustability. The present invention provides for comfortable wearing and walking in a shoe or boot having an inner sole in accordance with the present invention. The foam inner soles of the past have only a limited value and limited shock absorbency. The remainder of the prior devices, including the pressurization system for ski boots, are relatively complex and costly, and are often too bulky and cumbersome. Consequently, these devices are not readily acceptable for everyday activities.

In my prior patent (U.S. Pat. No. 5,846,063) 1 disclose and claim inflatable linings or inner soles with on board inflation pumps and relief valves which are readily adaptable to mass manufacturing techniques. An application of the inflatable enclosure of the present invention is that of an inflatable inner sole for footwear. The present invention provides a light weight, shock-absorbing inflatable lining or inner sole which enhances the fit, stability and comfort in footwear. The terms "inner sole" and "insole" are used interchangeably in this disclosure, and it is to be understood that each of these terms refers to removable linings as well as to insoles that are permanently connected to or integral with a pair of shoes. That is, the principles of the present invention may be applied to either removable insoles or permanent insoles with similar advantages in each application.

The present invention may provide the aforementioned inflatable lining or inner sole with at least one on-board air pump and relief valve to permit the wearer to adjust the lining from firm to soft support, as desired for the wearer's weight and/or activity. Additionally, specific areas, (for example, medial, lateral, heel, and/or front), could be made more or less firm which may be useful in medical/podiatry fields. Adjustment of firmness may be useful in post surgery treatment by an orthopedics practitioner.

The present invention may provide an inflatable lining as an inner sole for orthopedic footwear in order to treat and/or prevent foot disorders.

The present invention additionally provides an inflatable lining as an inner sole for footwear such as shoes, boots and sandals. The inner sole may have an arch pillow and a contour conforming to the wearer's foot, which will advantageously massage the wearer's foot.

The present invention may provide an inflatable lining with a surface which will reduce blister formation.

The present invention may provide the aforementioned inflatable linings or inner soles with a fabric and/or a foam covering for enhanced comfort.

The present invention also includes a simple methods for manufacturing of the inflatable linings.

The present invention may be a multi chamber system with a mechanism for inflation with connectors and relief valves located strategically in a recess. This recess may be located in the inner sole under an arch of a wearer's foot. The recess may also be surrounded by an arch pillow.

Other and related details will become apparent from the following descriptions of the present invention.

SUMMARY OF THE INVENTION

This invention comprises an inflatable lining for footwear which has sheet and/or foam coatings or surrounds for enhanced comfort and methods for its manufacture. Useful sheets may be plastic films or fabric which, when used, may be applied against the wearing surface of the lining or inner sole. Plastic foam, when used alone or in combination with sheets, may be applied to either surface of the lining. The plastic foam may be a surround which encapsulates the inflated lining. The inflatable linings or inner soles may be similar to those described in my prior patent (U.S. Pat. No. 5,846,063) which include an on-board air pump and relief valve.

The present invention includes a production process which may include making and/or using a prefabricated bottom part which may be molded. The bottom part may be sealed to an intermediate part. The intermediate part may be flat and forms an air tight enclosure or bladder to which may be added padding material and/or custom-made shoe inserts (orthoses). Then an upper part may be added and the bottom intermediate, and upper parts may all be sealed together.

This invention may also include a few alternative designs that my be useful in medical fields. One embodiment may have separate chambers for a heel, arch and forefoot portion of a patient's foot. The inner sole may also have separate chambers on medial inward and outward lateral sides of the inner sole, thus helping a podiatrist in treating pronations, supinations, etc. Connectors/valves with release valves which are in communication with respective chambers are strategically located under an arch of the wearer's foot. These connectors/valves may be surrounded by an arch pillow. An air pressure gauge indicating an air pressure inside one or more bladders may also be provided to aid in adjusting the stiffness or softness of the bladder.

This invention comprises an inflatable lining or sole for footwear that meets the above objectives. To achieve these objectives, the inflatable sole has an inflatable inner sole with a built-in air pump and a relief valve and at least one additional upper chamber formed by heat sealing (welding) an additional outer layer on top of inflated inner sole. The outer layer may be bonded only to the edges of the inflatable enclosures to permit free air/fluid flow from pressure point area to the area of least resistance and greatest need. Air pressure of the lower chamber can be adjusted according wearers weight and activities. The upper chamber can also be provided with a built-in air pump and a relief valve, preferably with lesser air pressure that can be adjusted according wearers foot problems or for final comfort tuning. The outer layer can be a laminated material of thermoplastic film, foam and/or fabric. The inflatable linings are preferably similar to those described in my prior patent (U.S. Pat. No. 5,846,063) which includes an on-board air pump and a relief valve, and to my prior patent (U.S. Pat. No. 6,510,624), (both of which are incorporated herein by reference).

In a simple form, the present invention includes an inflatable inner sole for footwear that has an inflatable first enclosure formed of first and second sheets of plastic film bonded together by a continuous seam defining a peripheral flange surrounding a surface field and forming a sealed interior. The sealed interior may have a plurality of discontinuous seams extending across the surface field to form interconnecting, internal passageways within the sealed interior. The inflatable inner sole may also include a flexible cover sheet overlying the upper surface of the sealed first enclosure, said flexible cover sheet may have an underlayer. The underlayer may be bonded about its periphery to the peripheral flange and unbonded to the field of the upper surface. Thus, the underlayer and the peripheral flange become a single homogenous material that cannot be distinguished into the first sheet, the second sheet, and the underlayer of which the material is formed. Furthermore, a second enclosure is formed adjacent to the first enclosure and an insert of padding material may be disposed within the second enclosure for support and comfort to the user. A pump may be fluidly connected with said sealed interior of the first enclosure so that the first enclosure may have a first chamber selectively inflated under pressure and the second enclosure may form a second chamber at substantially atmospheric pressure for enhanced comfort.

A method of forming an inner sole for a shoe in accordance with the present invention may include forming an inflatable enclosure by attaching a first sheet to a second sheet along a continuous seam. The method may also include placing at least one slit in each of the first and second sheets with the slit extending from an edge of the sheets transversely toward the continuous seam. The step of placing may include placing the slit adjacent to at least a portion of an inflation mechanism connected to an inflatable enclosure formed by joining the first and second sheets. The method may further include overlapping an overlying portion of each of the first and second sheets on one side of the slit with an underlying portion of each of the first and second sheets on another side of the slit. It is to be understood that the step of overlapping may be achieved automatically by the step of inflating the first enclosure.

Still further, the method may include attaching a third sheet to the first and second sheets while the portions of the first and second sheets are overlapped on each other. The method may also include placing an insert between the third sheet and the first enclosure.

The method may include a step of holding the portions in an overlapped state by at least one fastener connected to each of the first and second sheets. Additionally, the method may include placing one or more additional slits in the first and second sheets. The one or more additional slits may extend transversely relative to the continuous seam. The natural tendencies of the first enclosure is to wrinkle when inflated. That is, when some of the material forming the first enclosure is forced out of a plane, other non-inflated material around the peripheral seam tends to buckle.

The method may include forming a recess in the first and second sheets by bending a second portion of the first and second sheets out of a plane of intersection of a first portion of the first and second sheets. The step of placing may include placing the slit at a location adjacent to the second portion of the first and second sheets. The step of overlapping may result in a simultaneous step of bending the first and second sheets out of the plane.

In another simple form, the method may include protectively surrounding an inflation mechanism by forming a recess in an inner sole for a shoe. The method may thus include sealing a first sheet to a second sheet generally in a plane and forming a recess by causing at least one of the first and second sheets to bend out of the plane. The method may include holding the at least one of the first and second sheets in a bent state.

The step of causing at least one of the first and second sheets to bend may include a step of inflating an inflatable enclosure formed between the first and second sheets. The step of causing at least one of the first and second sheets to bend may include a preliminary step of molding the at least one of the first and second sheets in a preliminary step. The step of causing at least one of the first and second sheets to bend may include a step of overlapping overlying portions of the first and second sheets with underlying portions of the first and second sheets and retaining the portions in an overlapped condition. The step of retaining may include sealing a third sheet to at least one of the first and second sheets.

The step of forming may include forming the recess in the first and second sheets at a position corresponding to at least a portion of an inflation system and substantially surrounding the portion of the inflation system by portions of the first and second sheets that form the recess.

The method may further include attaching a third sheet to at least one of the first and second sheets and placing an insert between the third sheet and the at least one of the first and second sheets. The step of placing the insert may include placing the insert in overlying relation to the recess and at least a portion of an inflation system that is disposed in the recess. The step of placing an insert may include placing a contoured orthotic element.

In a simple form, the inflatable inner sole of the present invention may include at least a first sheet and a second sheet sealed together along a continuous seam lying generally in a plane and forming an inflatable enclosure. The inflatable inner sole may include an inflation system fluidly connected to an interior and an exterior of the inflatable enclosure. The inflatable inner sole may include a medial recess formed by at least a portion of the first and second sheets. A base of the medial recess may extend out of the plane. At least a portion of the inflation system may be disposed within the medial recess.

A pressure gauge may also be fluidly connected to the interior of the inflatable enclosure. The pressure gauge includes a generally see-through tube and a movable diaphragm in the see-through tube.

The inflation system may include a pressure relief valve having a sleeve for surrounding a spring loaded valve stem. The sleeve may include a radially inwardly extending spring seat flange.

At least one of the sheets of the inflatable inner sole may include a prefabricated molded sheet having a predetermined contour forming passageways for air flow within the interior of the enclosure of the inflatable inner sole. The prefabricated molded sheet may further include at least a portion of the inflation system. At least a portion of the inflation system may be formed as one piece together with a remaining portion of the prefabricated molded sheet.

The inflatable inner sole may further include a third sheet sealed to at least one of the first and second sheets. An insert may be disposed between the third sheet and the at least one of the first and second sheets. For example, the insert may be disposed between the third sheet and the enclosure formed by the first and second sheets.

Additional aspects may include the cover sheet provided as a laminate of fabric and the underlayer with the underlayer including a plastic material. The padding material may include an overlay sheet lying between the cover sheet and the first enclosure and spanning across the field of the inflatable enclosure. Alternatively, the padding material may be sized and positioned to cover only an arch portion of the inner sole. The flexible cover sheet may include a flexible synthetic thermoplastic.

The inflatable inner sole may include discontinuous seams in an arch area of the inner sole which form a medial recess for receiving a pump. These discontinuous seams also providing an arch pillow as an additional arch support in the inner sole. The inflatable inner sole may include the pump that is an air pump mounted in the medial recess and including a flexible bulb with a valve inlet port having an inlet check valve and a valve outlet port having an outlet check valve. The pump may further include an air pump housing located in the recess with the check valves mounted in the housing and also including a normally closed pressure relief valve having a valve operator accessible in the recess to release air from the sealed interior. Furthermore, the inflatable inner sole may further include an additional pump fluidly connected to the second enclosure.

In another simple aspect, the inflatable inner sole may include an upper portion, an intermediate portion, and a lower portion. The upper portion, the intermediate portion, and the lower portion may be connected to each other to form substantially a first air tight enclosure between the intermediate portion and the lower portion and a second air tight enclosure between the upper portion and the intermediate portion. A first pump may be fluidly connected to the first enclosure for selectively adjusting a gas pressure within the first enclosure. A second pump may be fluidly connected to the second enclosure.

As before, a padding material may disposed in the second enclosure between the upper portion and the intermediate portion for added support and comfort. The padding material may be disposed in an arch portion or other portions of the inner sole. The padding material may be provided in a substantially entirely overlapping relation relative to the inner sole. The padding material may include a foam material, a semi-rigid material, a resilient material that provides a spring effect to a user of the inner sole, and/or a gel that forms a custom arch support when pressed under a weight of a user. In this aspect, the padding material may be defined as including both gel and a gas.

It should also be noted that a lubricant may be provided in the second enclosure to facilitate sliding movement between the upper portion and the intermediate portion in order to reduce formation of blisters on the user's foot. While reaching this objective may benefit others, it is contemplated that doing so will most greatly benefit more aggressive users such as marathon runners, for example.

The foregoing and other features and advantages of the present invention will be apparent from the following more detailed description of the particular embodiments of the invention, as illustrated in the accompanying drawings.

BRIEF DESCRIPTION OF THE DRAWINGS

The invention will be described with reference to the figures of which.

DETAILED DESCRIPTION OF THE INVENTION

Figure 1:
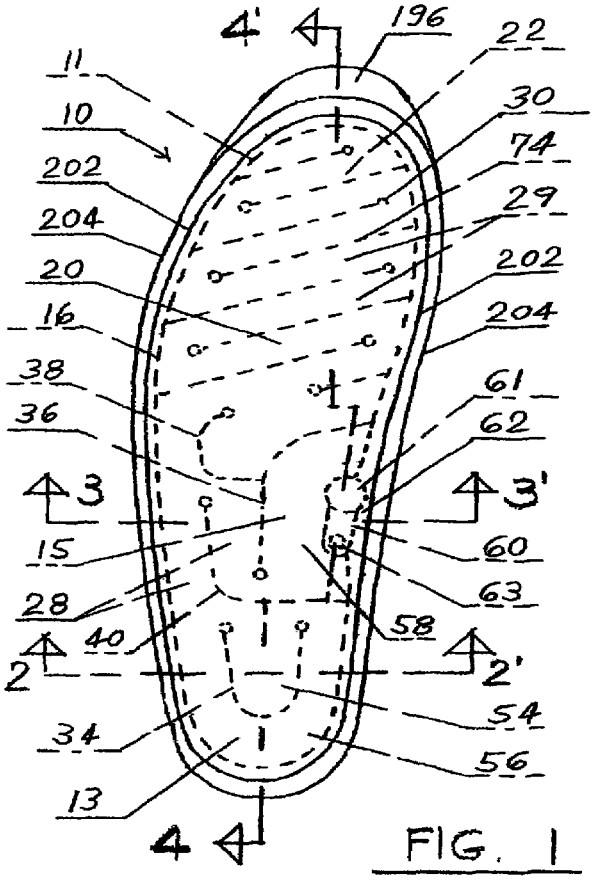
FIG. 1 is a plan view of an inflatable inner sole with a lower and an upper chamber with an on-board air pump and an adjustable relief valve.
Figure 4:
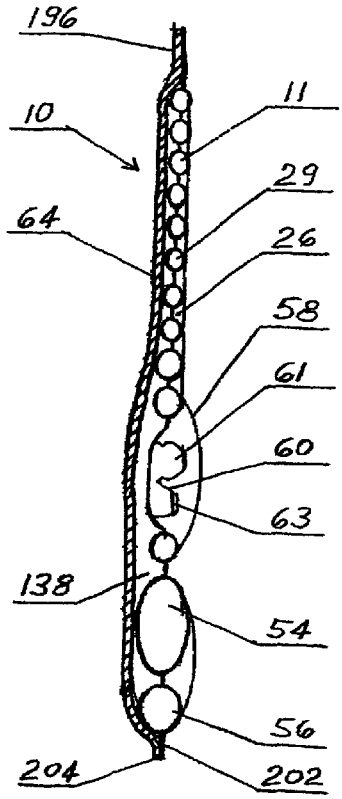
FIG. 4 is a cross sectional view along line 4-4 of the inner sole of FIG. 1.
Figure 3:
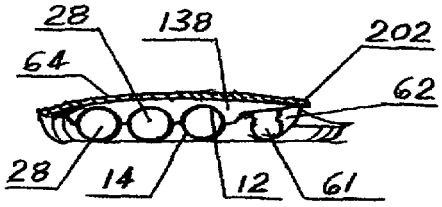
FIG. 3 is a cross sectional view along line 3-3 of the inner sole of FIG. 1.
Figure 2:
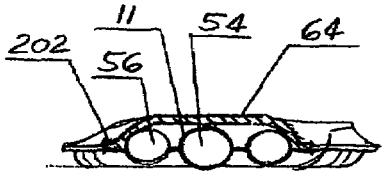
FIG. 2 is a cross sectional view along line 2-2 of the inner sole of FIG. 1.
Figure 5:
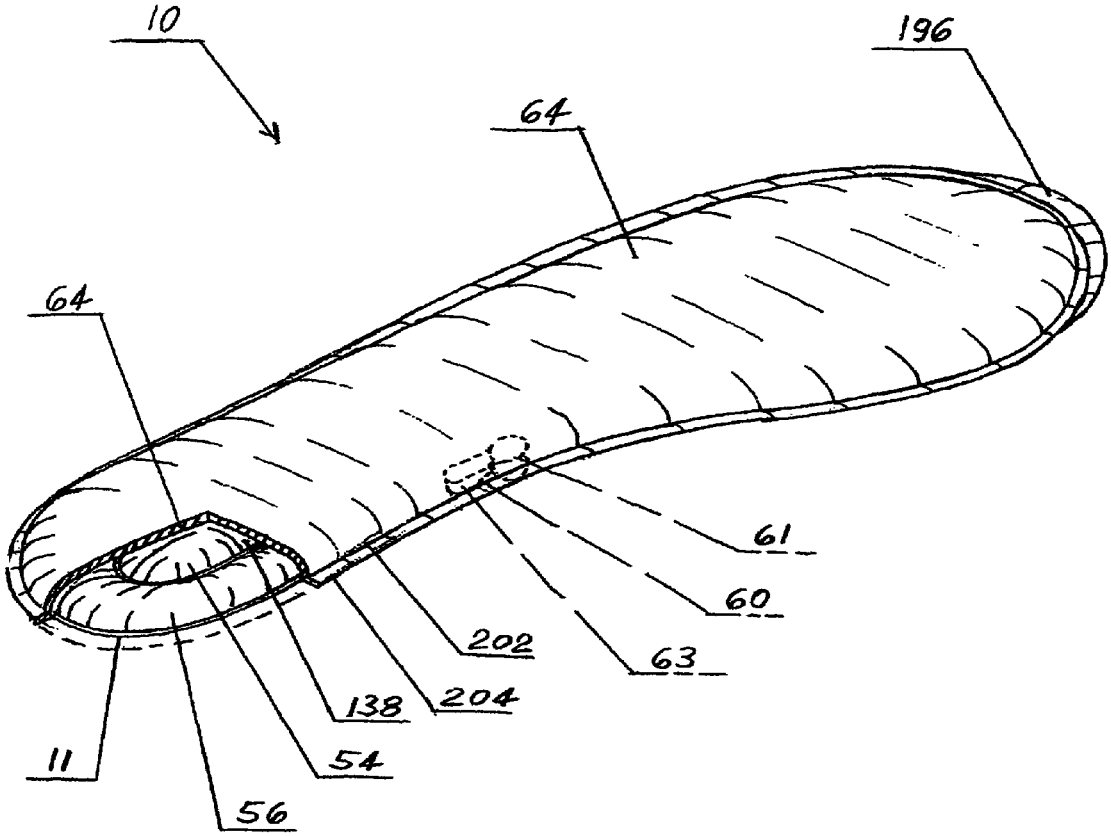
FIG. 5 is a perspective view of the inflatable inner sole of FIG. 1.

Referring now to FIGS. 1-5, the invention as applied to an inflatable inner sole will be described. The inflatable inner sole 10 is shown in a plan view in FIG. 1, in sectional views in FIGS. 2-4, in perspective, partial sectional view in FIG. 5 and in an enlarged sectional view in FIG. 7. The inflatable inner sole 10 which has an inflatable enclosure 11 that extends across the entire sole including the heel area 13, the arch or instep area 15, the toe area 22 and metatarsal area 20. The inflatable enclosure 11 is formed by a first sheet 12 and a coextensive second sheet 14 of substantially the same shape and size. These sheets can be best seen in the enlarged sectional view of FIG. 7. The first and second sheets (films) 12 and 14 are bonded together in a continuous peripheral seam 16 that extends about the heel area 13, the instep area 15 and toe area 22 of the inner sole 10.

The first and second sheets (films) 12 and 14 are plastic, and may be thermoplastic, so that conventional heat sealing can be used for forming the seams. The thermoplastic material may be polyurethane. However, other suitable materials include ethylene, and ethylene vinyl acetate copolymers, polyethylene, polypropylene, polyvinyl chloride, etc.

The first sheet 12 and the second sheet 14 are also bonded together with a plurality of discontinuous seams 34, 36, 38 and 40 which form tubular, interconnecting passageways 56 through the heel area 13 and passageways 28 through the instep area 15 of the inner sole 10. The inflatable enclosure 11 also has a plurality of discontinuous, transverse seams 74 in the metatarsal area 20 and toe area 22 to impart flexibility to the inner sole 10 and to form interconnecting passageways 29 which extend across these areas to permit the wearer to control the firmness and support of the inner sole simply by controlling the inflation pressure within the inflatable enclosure 11.

The spacing between adjacent seams controls the size or diameter of the passageways 28 and 29. If desired, some areas of the inflatable enclosure 11 can be unseamed to form air pillows. The size and spacing of the interconnecting passageways and pillows can easily be varied during manufacture to adapt the inner sole to the particular shoe. Thus, the pillows and passageways in the arch area can be small in size to fit conventional shoes with integral arch supports or large in size for use with shoes having flat or nearly flat soles to provide an arch support. In either case, the firmness of the inner sole 10 can be regulated by adjustment of the air pressure within the inflatable enclosure 11.

There are also circular or closed loop seams 30 to provide end points of the internal seams. These closed loop seams 30 may encircle through openings that extend entirely thorough the first and second sheets 12 and 14. The closed loop seams 30 provide ends for the discontinuous or internal seams, which ends are rounded and thus tend away from failure of the material near the ends of the seams. The spacing, size and number of the discontinuous seams can be varied greatly, as desired, to provide the maximum comfort and convenience to the wearer of a shoe fitted with the inflatable inner sole 10.

The C-shaped heel seam 34 forms a heel pillow 54 and a heel peripheral tubular passageway 56. There is a small C-shaped arch pillow 58 which is formed by seams 16, 36 and 40 and which forms a medial recess 62 that receives the inflation assembly 60 which includes an air pump 61 and relief valve 63. The inflatable inner sole 10 in one embodiment is intended for use as a replacement insert for shoes which have some arch support. Therefore in this embodiment of the inner sole 10 a small arch pillow 58 is sufficient to encircle the pump and relief valve assembly 60. Alternatively, the arch pillow could be made larger for use of the inner sole with shoes having smaller existing arch supports.

In addition to the inflatable enclosure 11, the inflatable insole 10 has an additional chamber 138 formed on top of inflated enclosure 11 by heat sealing or welding outer layer 64 to the inflatable enclosure 11. To this end, the outer layer 64 may be heat sealed only to the edges of the inflatable enclosure, thus forming peripheral seams 202 and 204. Outer layer 64 may be a laminated material of thermoplastic film, foam, and fabric. An acceptable material for the outer layer 64 may be any of a variety of medium to high density urethane foams, examples of which are marketed under the trademark "HyPUR-cel", produced by the company, Rubberlite of Huntington, W. Va. Outer layer 64 may be heat sealed to the inflatable enclosure 11 after enclosure 11 is inflated so that a certain amount of air is captured inside newly formed chamber 138. In this assembly, air pressure inside upper chamber 138 is atmospheric. When a wearers heel and/or forefoot apply pressure on insole the air from pressed area will move to the area of least resistance and greatest need, and provide additional support for the user's arch. The air pressure of the lower chamber can be adjusted according to a wearers weight and activities and the air inside upper chamber can provide additional comfort and/or support. The compressibility of the outer layer 64 can be selected to provide a suitably soft and comfortable feel to the inner sole 10 and the firmness and shock absorbency of the inner sole 10 can thus be controlled by the inflation pressure which is maintained in the inflatable enclosure 11.

The upper or wear surface of the outer layer 64 is covered with fabric material 153. The fabric may be Nylon such as widely used in inflatables produced by Mann Industries, Inc., of Framingham, Mass., or material produced by Faytex Corp., Weymouth, Mass., like DRI-LEX® LINING, HYDROFIL® Nylon from Allied Signal. The moisture absorbing qualities of the HYDROFIL Nylon draws moisture away from the skin keeping the user dry, cool and comfortable. Also, insole 10 may have a non-inflated toe area 196 to be cut off if needed to fit in footwear of smaller shoe size. The under surface of the inflatable enclosure 11 rests on the inside wall of the sole of the footwear, forming open channels 26 beneath the enclosure 11. In reference to other illustrations of the invention, the components of this inner sole 10 which are similar to those previously described are identified with the same numerals as used in FIGS. 1-5.

Figure 6:
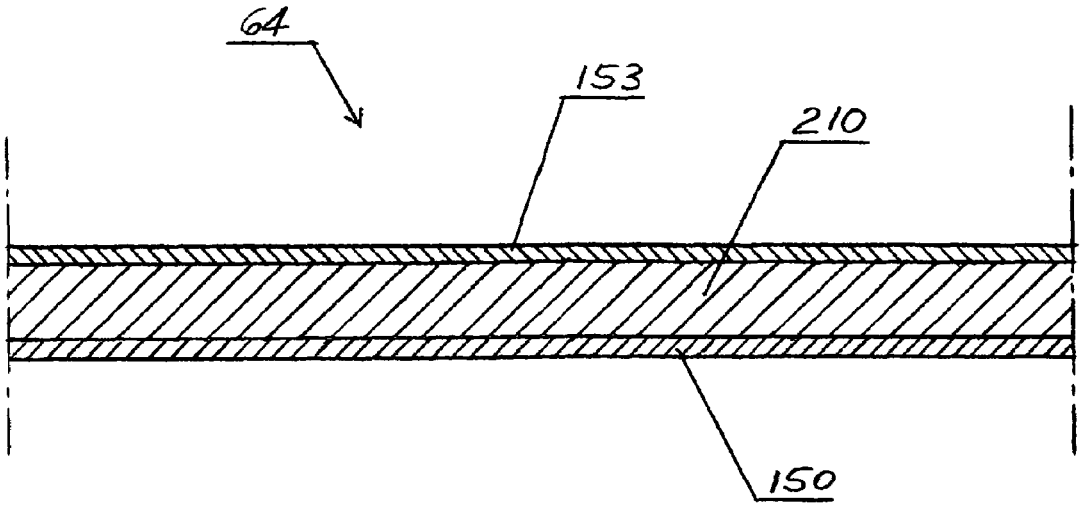
FIG. 6 is an enlarged cross sectional view of an outer layer.

FIG. 6 is an enlarge cross sectional view of outer layer 64, which is used to form upper chamber 138. Outer layer 64 is laminated with thermoplastic film 150 on a bottom, thermoplastic foam 210 in a middle and fabric 153 on a top. Thermoplastic film 150 provides reinforcement for thermoplastic foam 210 at a zone where stretching and/or bending forces are present. Thus, thermoplastic film 150 inhibits formation of the cracks on the outer layer 64, and especially at areas above seams on the enclosure 11. This is because the seams form recesses in the underlying field contour and the recesses tend to induce cracking over time when the outer layer 64 is not properly reinforced.

The inflatable insole may be produced by an electronic heat sealing process. Electronic sealing is accomplished by sending a high frequency or heating current through two or more layers of thermoplastic material placed between two sealing electrodes or dies. One die is shaped in the image of the required seal.

Figure 7:
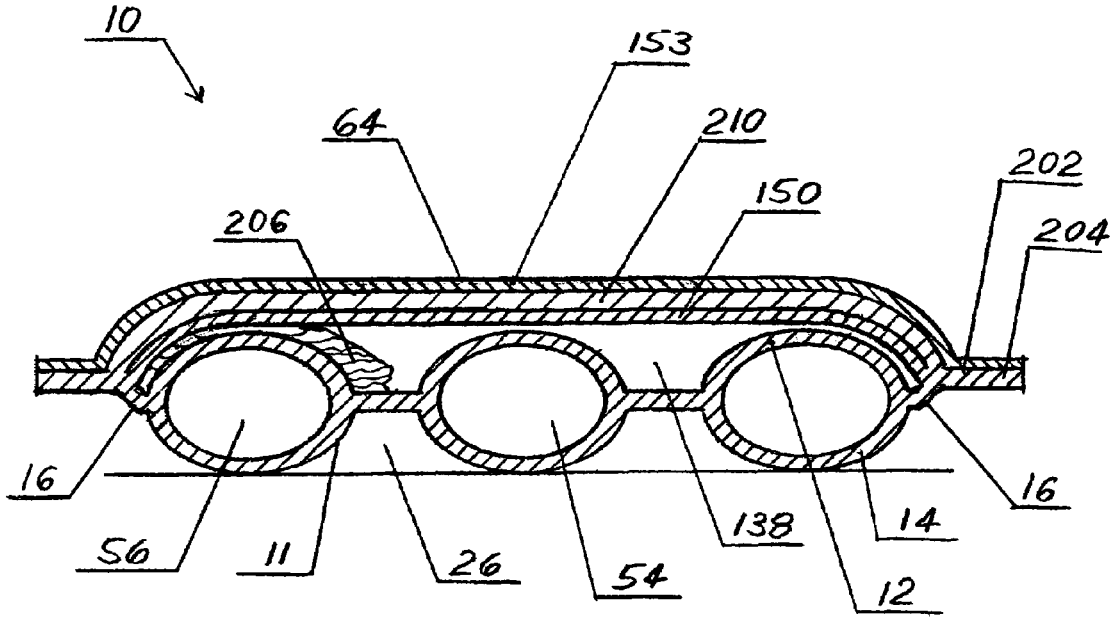
FIG. 7 is an enlarged sectional view similar to FIGS. 2 and 3 and showing the construction of the inflatable lining of the inner sole for the embodiments of FIGS. 1-5 and 13-20.
Figure 9:
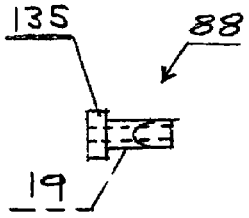
FIG. 9 is a view of a check valve used in the air pump and check valve assembly.
Figure 10:
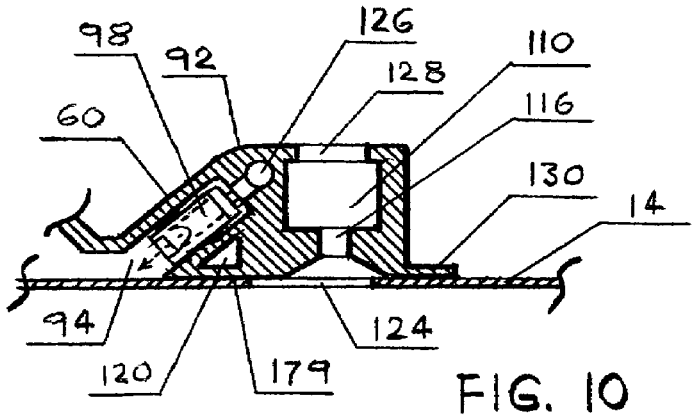
FIG. 10 is a sectional view along line 10-10 of FIG. 8, with the relief valve omitted.
Figure 8:
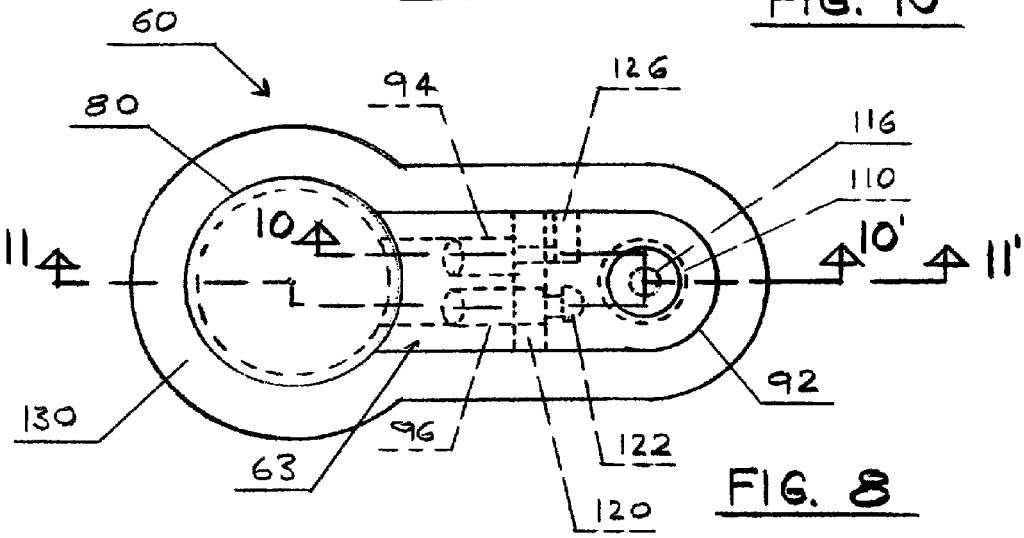
FIG. 8 is a plan view of the air pump and check valve assembly used with the inflatable linings.
Figure 11:
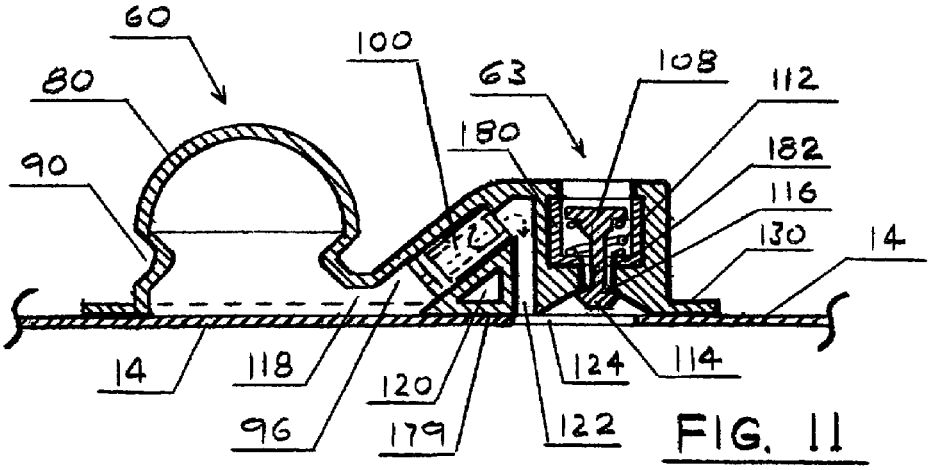
FIG. 11 is a sectional view along line 11-11 of FIG. 8.

FIG. 7 illustrates a typical cross sectional view of an inner sole 10 or 18. This inflatable inner sole is formed by placing the outer layer 64 over inflatable enclosure 11, in an inflated state, and heat sealing the outer layer 64 to the enclosure 11 with double peripheral seams 202 and 204. The outer layer may be bonded only at the edges of the inflatable enclosures to permit free air/fluid flow from pressure points area to the area of least resistance and greatest need. This arrangement also permits relative movement between an upper cover 64 and the inflatable enclosure 11, which reduces chances of blister formation on a user's foot. If desired, a minor amount of a lubricant can be inserted in the chamber 138 to reduce frictional resistance between the cover 64 and field surface of the enclosure 11.

Also, as an alternative, fluid or gel 206, such as silicon with any of a variety of selected densities and viscosities can be inserted into upper chamber 138 to provide an additional arch support. As shown by the breakaway line in FIG. 12, the fluid 206 is an alternative to air or other gases. As such, the entire enclosure may be filled with the gel 206. Further alternatively, the enclosure 138 may be partially filled with a gas and partially filled with gel 206 as shown in FIG. 7. In any case, the fluid or gel 206 may have a viscosity that stays in a particular shape into which it is formed. Thus, the gel 206 may be pressed into the arch area, for example, under pressure from a user's foot and remain there to form a custom arch support that is unique to the user. In this way, the inner sole also provides a dynamic arch support that may change as the user's foot squeezes the gel with greater or lesser pressure from the heal and forefoot of the user, for example.

The inner sole of the present invention may have an inflatable enclosure 11 which is inflated under pressure and another upper air chamber 138 at a lesser pressure for enhanced comfort and arch support. This inflation may be incorporated with or without gel 206 or other fluids. In any case, the bulk and weight of the inner sole may be kept more or less small.

FIGS. 8 through 11 are plan and sectional views of the pump and relief valve assembly 60 which permits the wearer to adjust the inflation pressure within the inflatable enclosure 11 to any desired comfort level or support. The construction and operation of this assembly is described in my prior patent (U.S. Pat. No. 5,846,063). The assembly 60 includes a compressible pump dome 80 which has an undercut 90 for ease of depression. The housing 92 of the assembly 60 has two cavities 94 and 96 which receive two duck-bill check valves (also shown in FIGS. 9 and 12); inlet check valve 98 and outlet (discharge) check valve 100.

Figure 12:
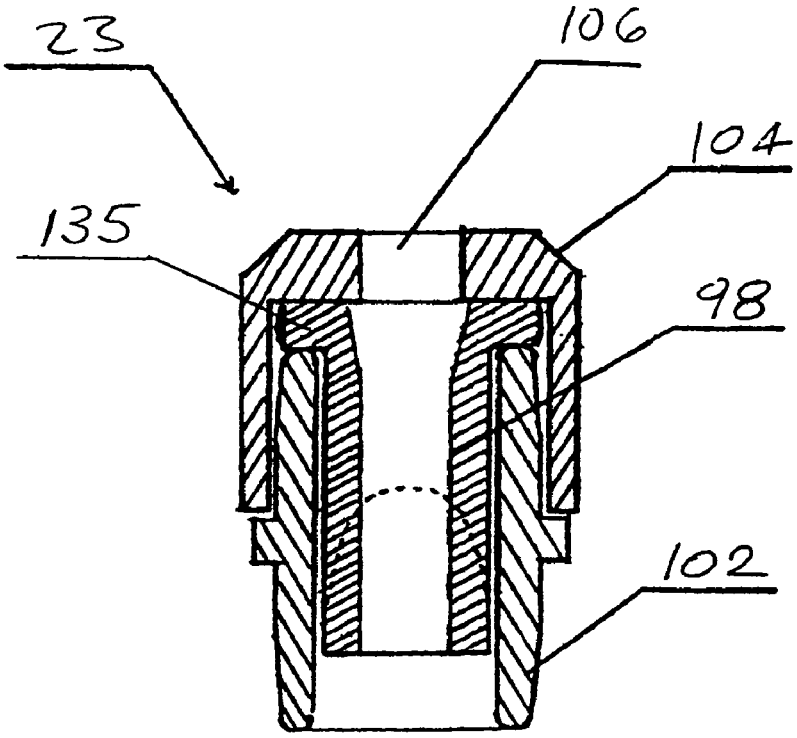
FIG. 12 is a sectional view of a check valve assembly useful in the air pump and relief valve assembly.

An enlarged cross-sectional view of a subassembly 23 of the check valves is shown in FIG. 12. Prior to insertion into the housing cavities 94 and 96, each of the duck-bill check valves 98 and 100 are inserted into a protective brass sleeve 102 and brass cup 104 which has an opening 106 for air passage. Each valve is captured in the assembly with its flange 135 locked between the sleeve 102 and cup 104. The assembly is then inserted into cavities 94 and 96 of the pump housing 92 illustrated in FIGS. 8-11. As the housing 92 is formed of soft plastic, the protective sleeves 102 and cups 104 prevent accidental squeezing of the check valves when forces are applied to the housing 92.

A relief valve operator 108 is inserted into a valve cavity 110 of the relief valve housing 92 and a coil spring 112 is positioned beneath the operator 108 to provide a biased force which seats the seal ball 114 on the lower end of the relief valve operator 108 to seat against the valve aperture 116. There is a passageway 118, which connects the cavity beneath dome 80 and check valve assembly 98 and 100. The outlet passage from check valve 100 extends over tunnel 120, through passageway 122 and through opening 124 on the first flexible plastic sheet 14 into the inflatable enclosure. The tunnel 120 accepts a mandrel (metal bar) which is a removable part of the metal sealing die to heat seal the area 179, beneath tunnel 120, to seal the entire periphery of the cavity beneath the dome 80, thereby providing air circulation only through the check valves 98 and 100. The inlet check valve 98 receives air through side opening 126 and discharges into the cavity beneath pump dome 80. There is a recess 128 on top surface of the relief valve housing 92 to prevent from accidental activation of the relief valve operator 108 when in contact with existing shoe lining. An aluminum sleeve 180 is inserted inside cavity 110 to reinforce housing 92 to prevent accidental squeezing and activation of the relief valve.

The sleeve 180 may have a radially inwardly extending spring seat flange 182 that receives a lower end of the spring 112 and inhibits detrimental penetration of the spring 112 into material of the housing 92. Thus, the spring seat flange 182 of the sleeve 180 has the advantage of extending the life of the pump and relief valve assembly 60. The sleeve 180 may comprise aluminum, brass, or another generally rigid material.

There is a flange 130 around the assembly 60 to permit permanent attachment of the assembly to a supporting surface, usually a plastic sheet, by heat sealing or any other alternative process.

Figure 13:
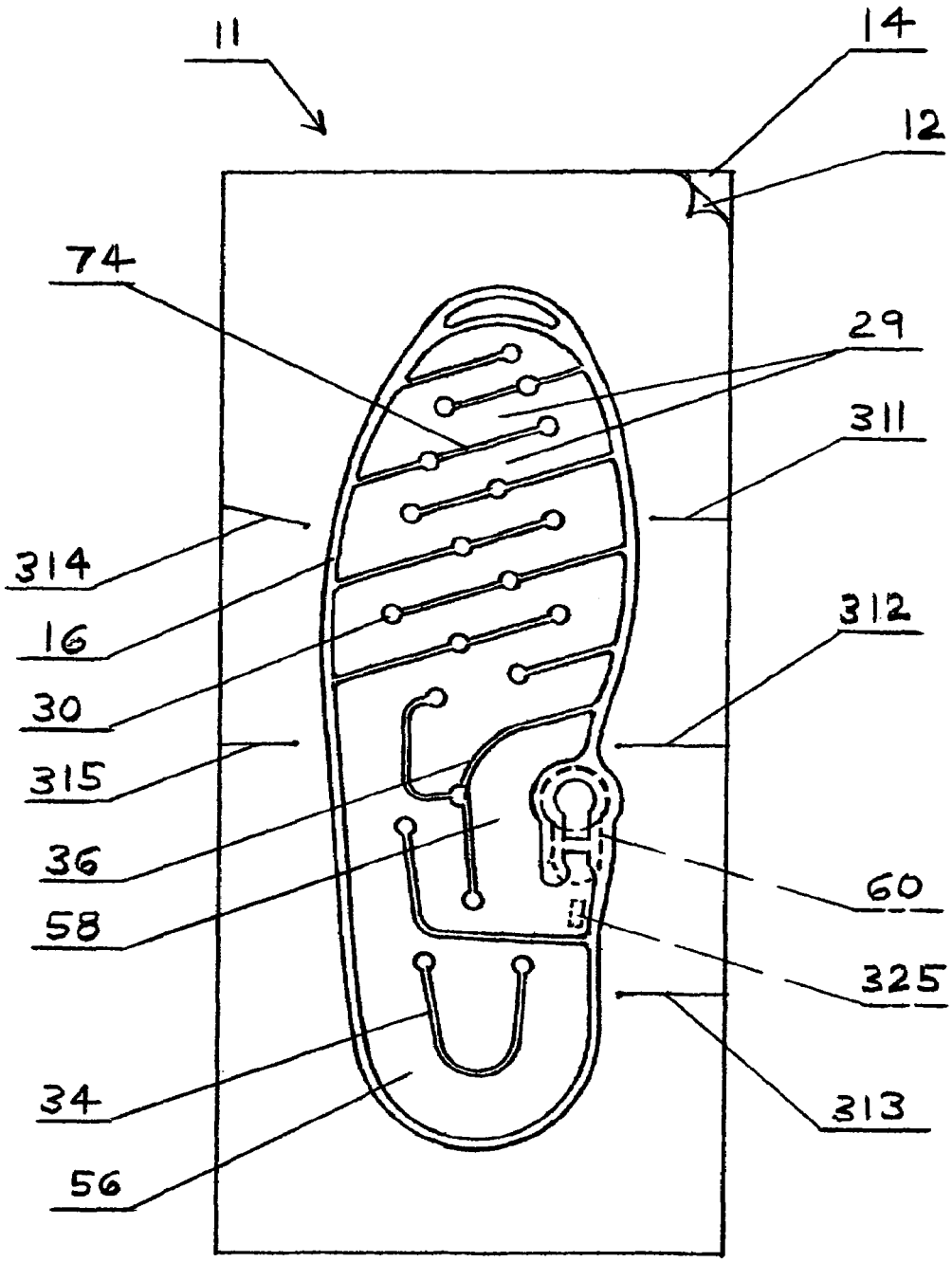
FIG. 13 is a plan view of an inflatable inner sole at the first stage of the production process.

FIG. 13 is a top plan view of an inflatable inner sole 10 formed of a first sheet 14 and a second sheet 12, which form the bladder 11. The sheets may be laid over each other. Slits 311,312, 313, 314 and 315 extend through the first and second sheet.

Figure 14:
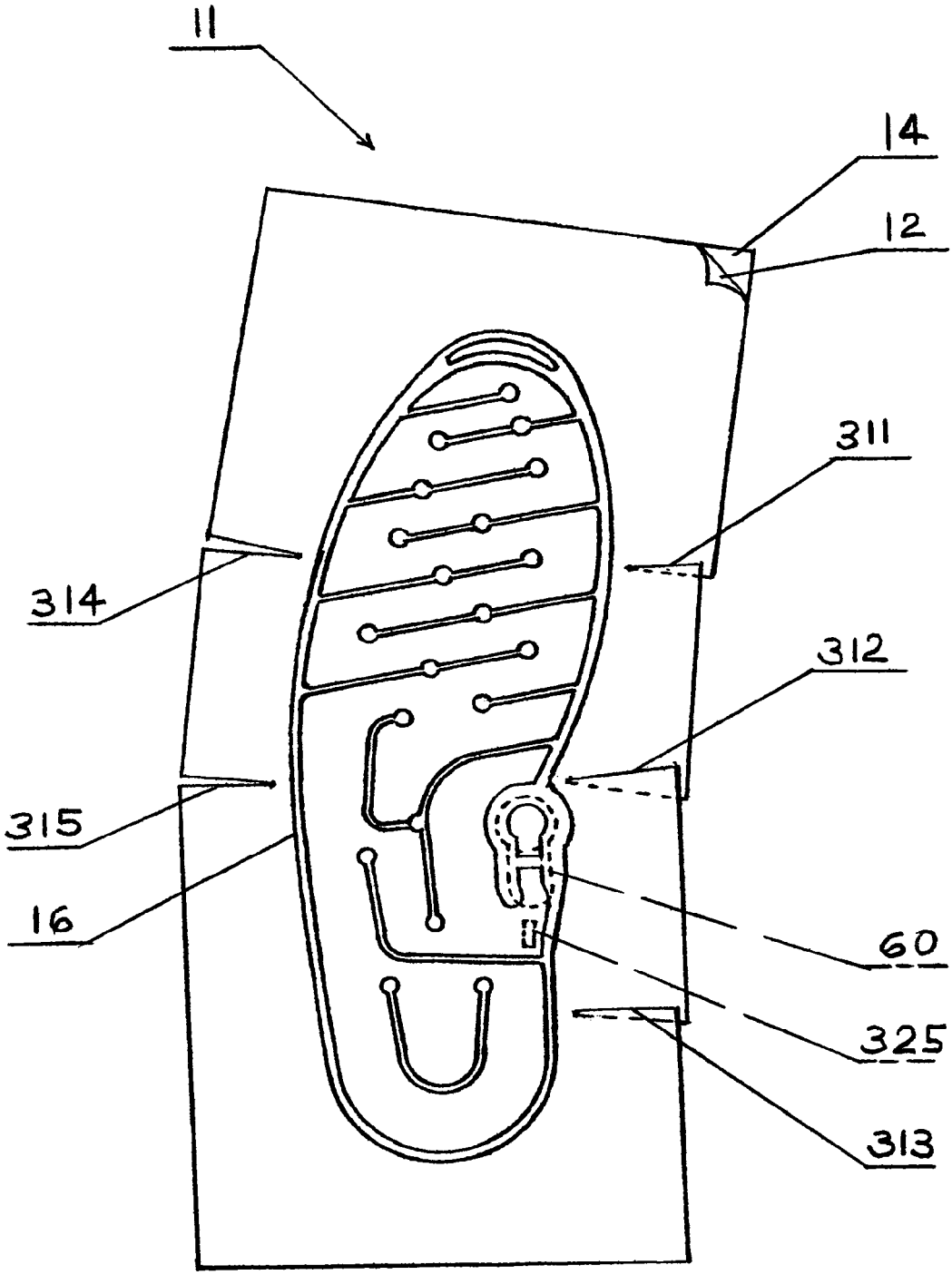
FIG. 14 is a plan view of an inflatable inner sole at the second stage of the production process.

FIG. 14 is a top plan view of the assembly 11 illustrated in FIGS. 1-5 with inflatable enclosure 11 inflated. When inflated, the entire enclosure or bladder 11 has a tendency to curve inward around the pump 60 on a medial inner side, and therefore forming the bladder in a kidney shape. When inflated, the change in shape causes surrounding material of sheets 14 and 12 to wrinkle. A plurality of slits 311, 312, 313, 314 and 315 may be strategically positioned in relationship with internal and peripheral seams 16 which form bladder 11. These slits allow material to overlap in certain areas inhibiting excess or uncontrolled wrinkling of the sheets 12, 14. As shown, the positions of the slits enable the slit 312 to form bigger overlap. With regard to slit 312, an edge of the slit closer to the pump overlaps over other edge of the slit when the bladder is inflated. Thus, this configuration forms a recess 62 for the pump and relief valve assembly 60. This configuration is important for a subsequent sealing process illustrated in FIGS. 15 and 16. Specifically, this configuration causes the sheet material and overall bladder 11 to keep a desirable shape with recess for the pump and relief valve assembly 60.

Figure 15:
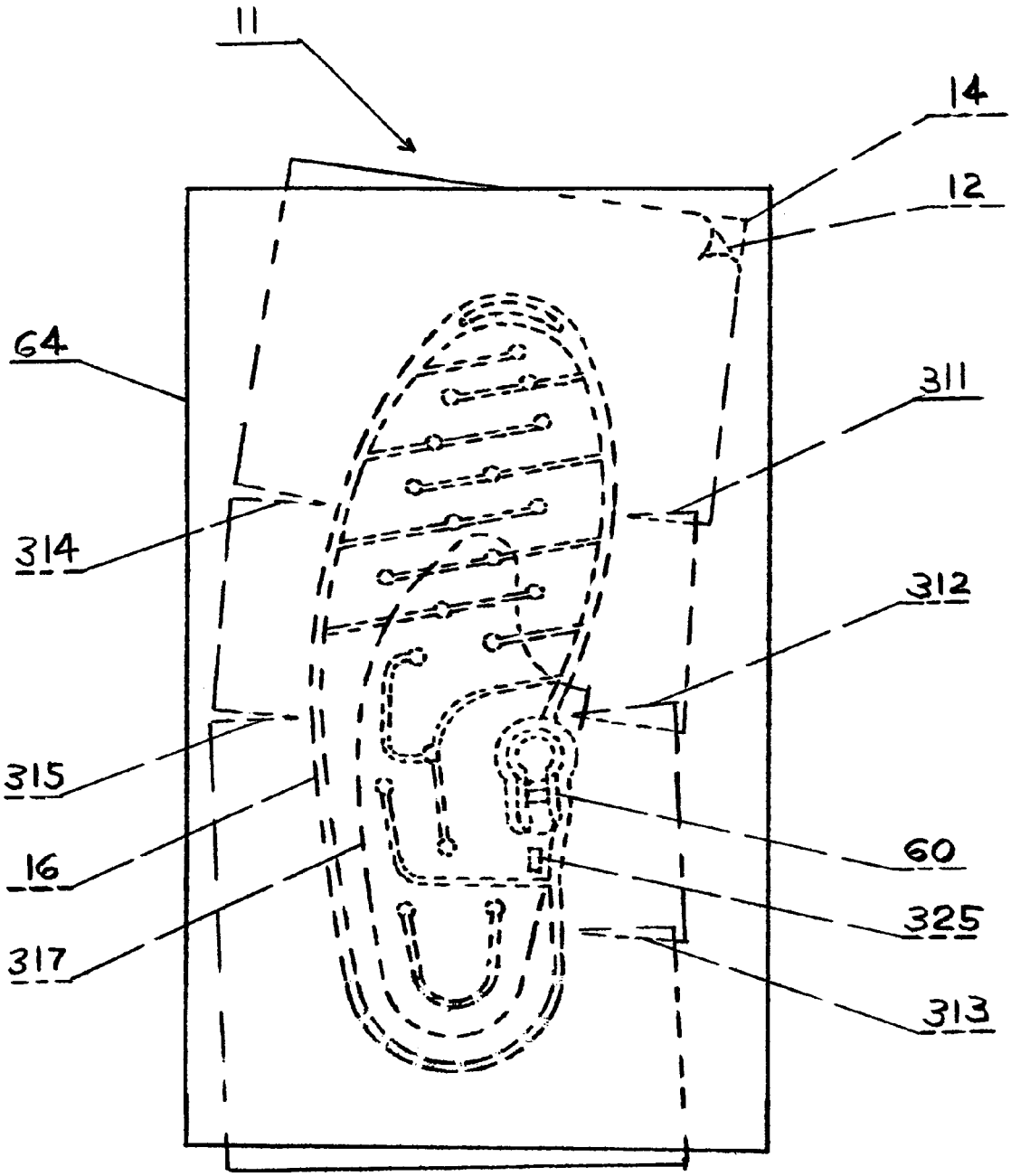
FIG. 15 is a plan view of an inflatable inner sole at the third stage of the production process.

FIG. 15 is a top plan view of the assembly illustrated in FIGS. 13 and 14 with outer layer 64 placed on top. The outer layer 64 may be laminated material of one or more of a thermoplastic film, foam and fabric. Also as shown, a foamy insert 317 may be positioned between bladder 11 and outer layer 64. In the embodiment shown, the insert 317 extends from a heel to a metatarsal area although it could have any of a variety of different shapes including those shapes covering the whole sole or only certain predetermined areas. The insert 317 and the outer layer 64 may be made of the same rubbery material, although it could be formed of materials like cork which forms to the contours of wearers foot after relatively short period time of use. Additionally, the inner sole 10 could have an additional layer of one of these or another material for extra arch support. The insert 317 can be a prefabricated, already contoured material such as to provide custom orthotics, for example (see FIG. 22). The outer layer 64 can be produced of foamy thermoplastic with any of a variety of different thicknesses and densities. (See also FIG. 30.)

Figure 16:
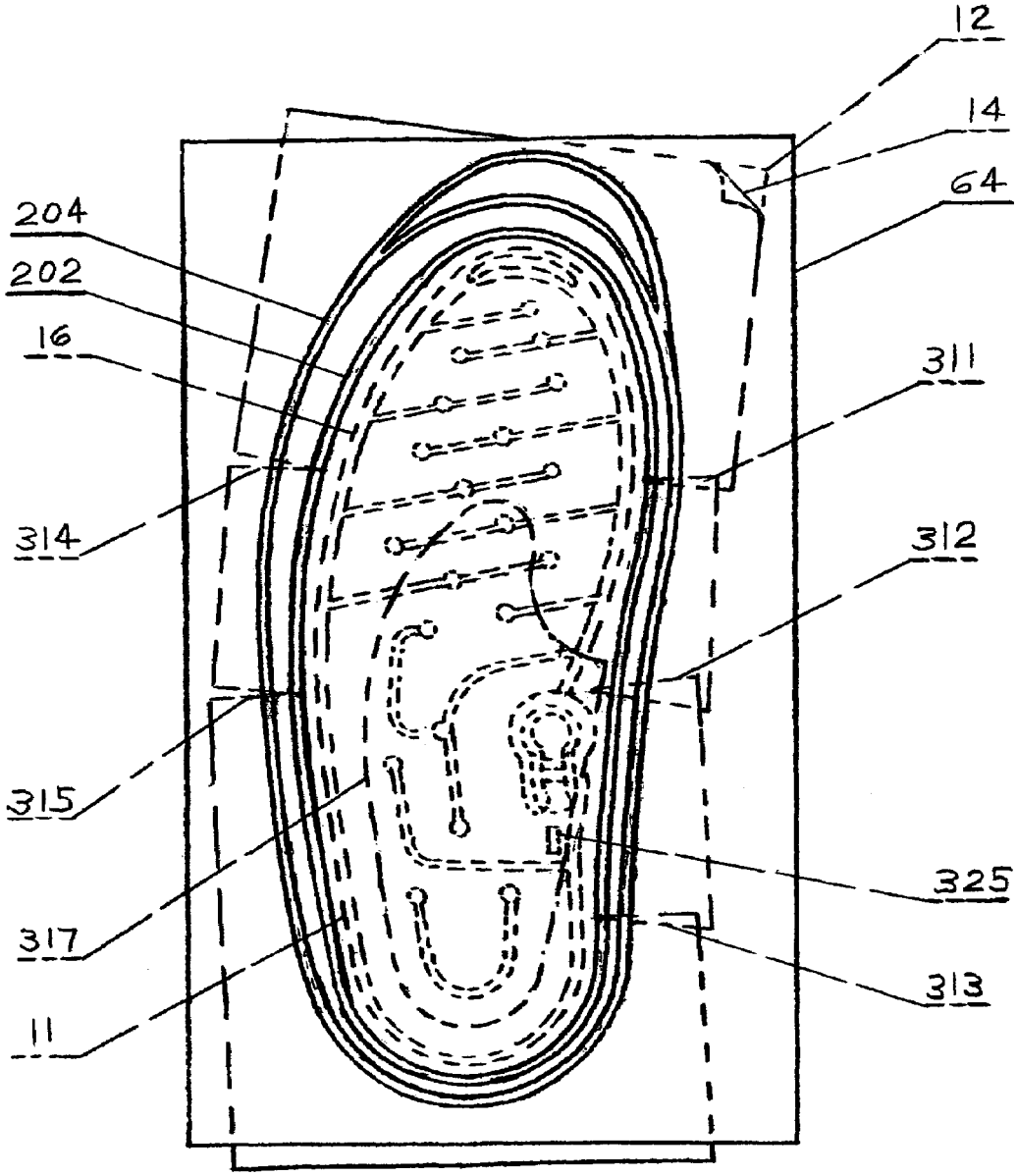
FIG. 16 is a plan view of an inflatable inner sole at the forth stage of the production process.

FIG. 16 is a top plan view of the assembly illustrated in FIGS. 13-15 with third and final seals 202 and 204 applied. The seals 202 and 204 may be heat seals formed by a lower plate, and a die that presses the sheets 12, 14 and the outer layer 64 together. The bonding process may be heat sealing or welding.

Figure 17:
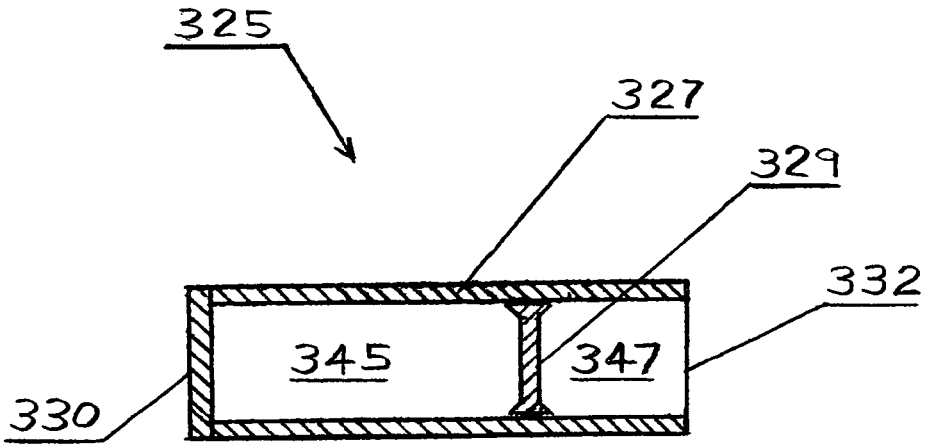
FIG. 17 is cross sectional view of an air pressure gauge.

FIG. 17 illustrates air pressure gauge 325. FIGS. 13-16 show an exemplary location for the pressure gauge 325 within the bladder 11. The air pressure gauge may have transparent hard plastic tube 327 with diaphragm 329 inserted inside. The tube 327 may be closed at one end 330 and open on other end 332.

Figure 18:
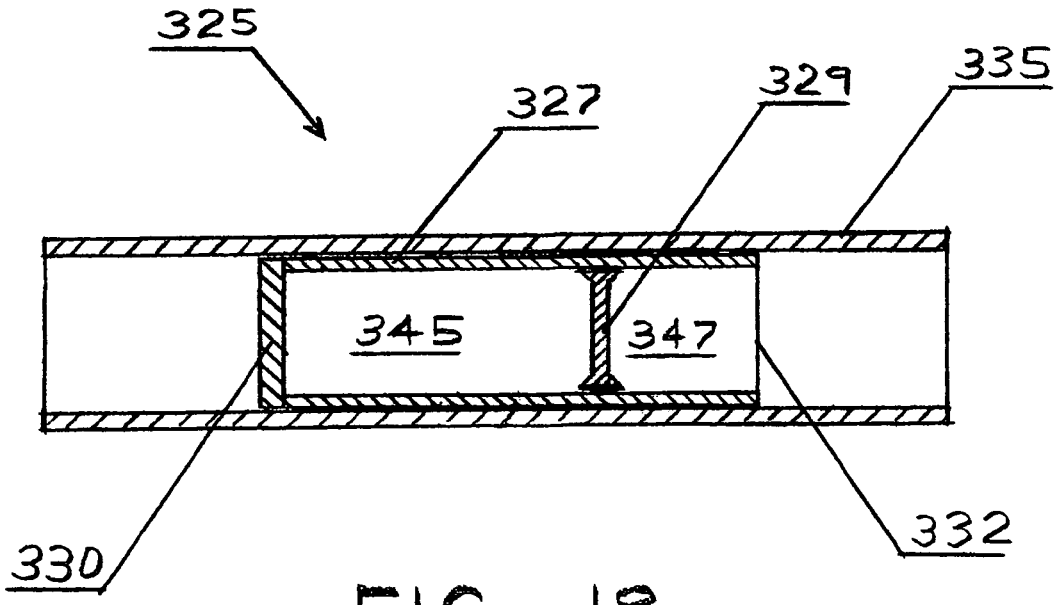
FIG. 18 is cross section of the air pressure gauge illustrated in FIG. 17 and inserted into a flexible tube.

FIG. 18 shows the air pressure gauge 325 with the hard plastic tube 327 and diaphragm 329 inserted inside of a flexible tube 335. The flexible tube 335 and hard plastic tube 327 may be made of transparent thermoplastic material such as polyurethane, for example. The entire assembly including the flexible tube 335 with the air pressure gauge 325 may then be positioned near the relief valve 63 between first and second sheets 14 and 12. An end of flexible tube 335 which extends past the closed end 330 of the hard plastic tube 327, may be pinched and/or sealed with one of the internal or peripheral seals for permanent positioning of the flexible tube 335 and the air pressure gauge 325 during the second heat sealing process which forms the bladder 11.

Inserting diaphragm 329 inside the hard plastic tube 327 and closing the one end 330, forms a chamber 345 which has an air pressure equal to an air pressure on the other side 347 of the diaphragm 329. Thus, when air pressure inside the bladder of the inflatable insole is increased the diaphragm 329 moves to equalize air pressure on both sides of the diaphragm. Lines may be engraved or printed on the hard plastic tube 327. The lines may be parallel with the diaphragm 329 to enable a graduated measurement. The main purpose of having the air pressure gauge 325 is so that wearers can visually monitor and maintain the same air pressures in a left and a right insole as desired. The first sheet 14 will be transparent so air pressure inside bladder can be read from outside. If needed the pressure gauge 325 can be located in any other area. For example, the pressure gauge 325 may be located remotely inside a closed tube which extends to an accessible location on the shoe so it can be easily read by a user without taking the inner sole 10 out of shoes. Additionally or alternatively, other types of air pressure gauges can be used without departing from the spirit and scope of the invention.

Figure 19:
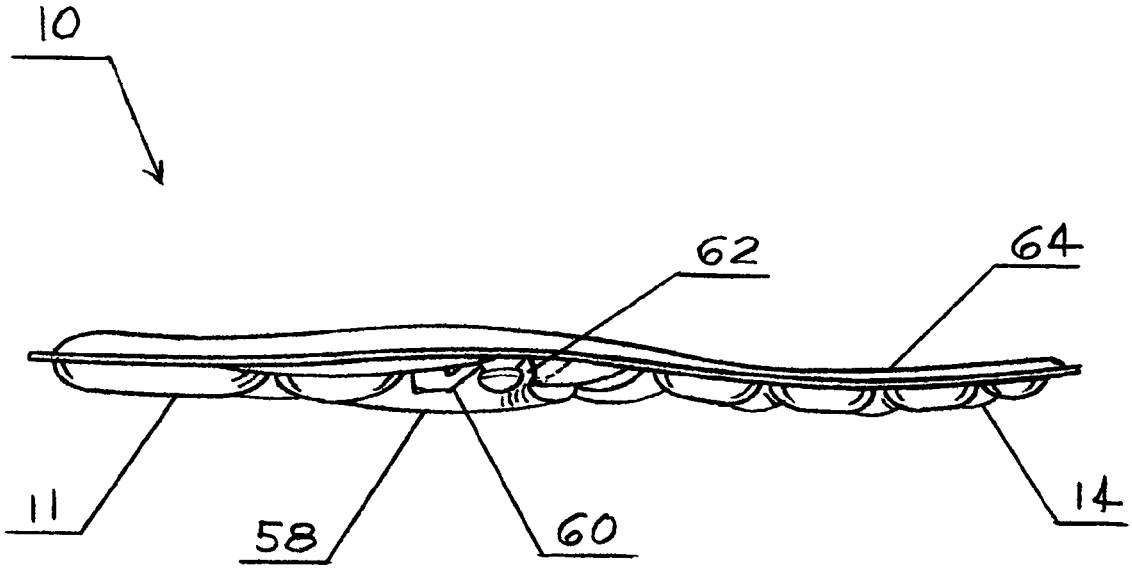
FIG. 19 is a medial (laterally inner) side view of the insole presented in FIGS. 1-18.

FIG. 19 is a medial (laterally inner) side view of the inner sole 10 of FIGS. 1-18. FIG. 19 shows the bladder 11, the outer layer 64, the pump and relief valve assembly 60, and the formed recess 62. FIG. 19 also shows how an upper portion of the inner sole 10 may conform to a contour of a wearers foot after a short period of use. It should be noted that the pump may have a shorter profile than the arch formed by the structure that also provides the recess 62.

Figure 20:
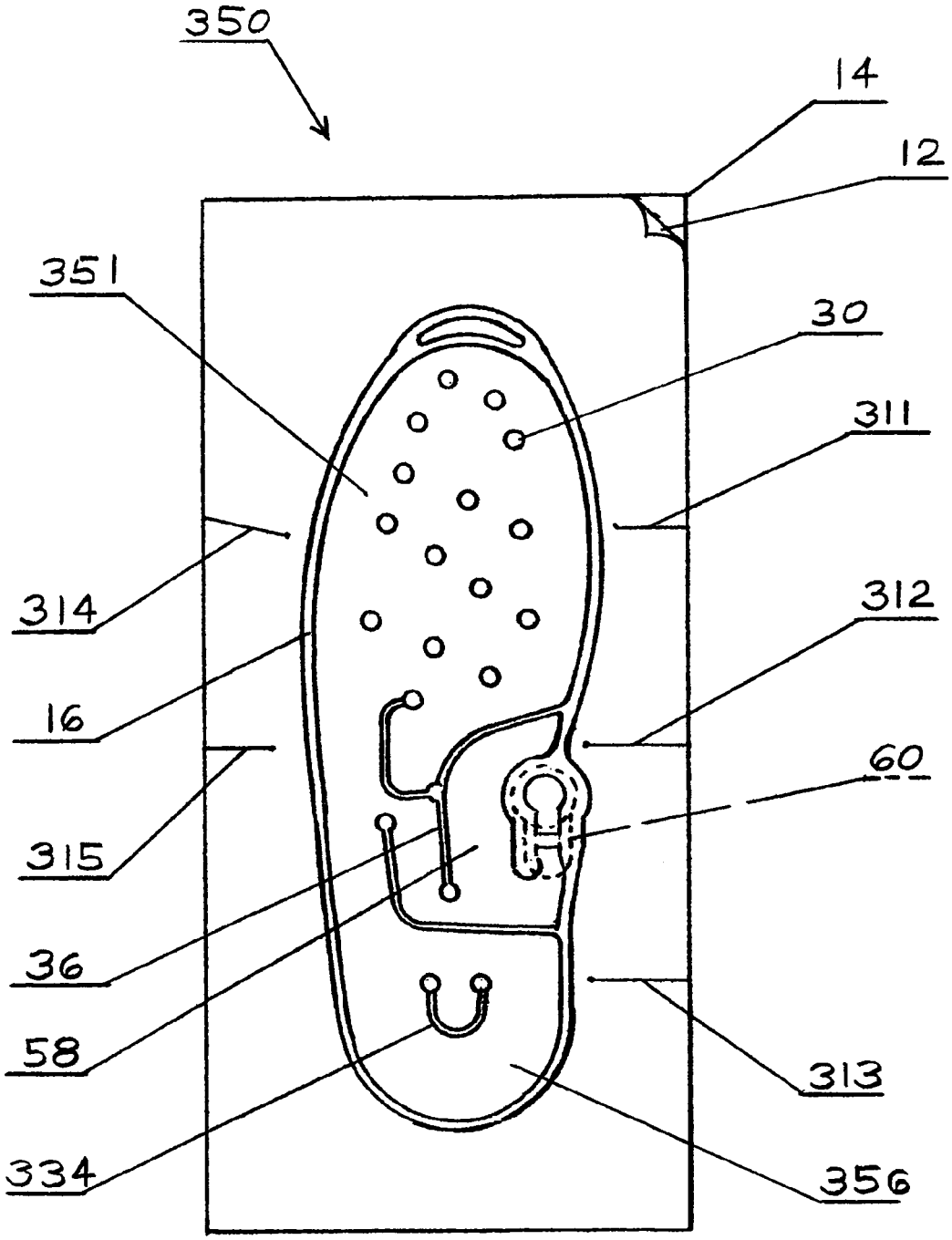
FIG. 20 is a plan view of an inflatable inner sole according to an alternative configuration at the first stage of the production process.

FIG. 20 is a top plan view of an alternative embodiment of the inner sole 350 similar to the assembly shown in FIGS. 1-19. However, the parallel seams 74 in the forefoot and the metatarsal area are replaced by spot welds 30, thus providing a thicker bladder 351. A "U" shaped seam 334 may be reduced in size to also provide a thicker passageway 356 for air within the heel area. One of the purposes of the internal seams is to provide a certain volume, shape and thickness of the bladder. The particular configuration of inner sole 350 may require custom made shoes with a slightly enlarged cavity inside the outsole to provide space for the thicker bladder 351 shown in FIG. 20 for greater comfort. The embodiment of FIG. 20 may require a custom made shoe or may be formed integrally with a shoe.

Figure 21:
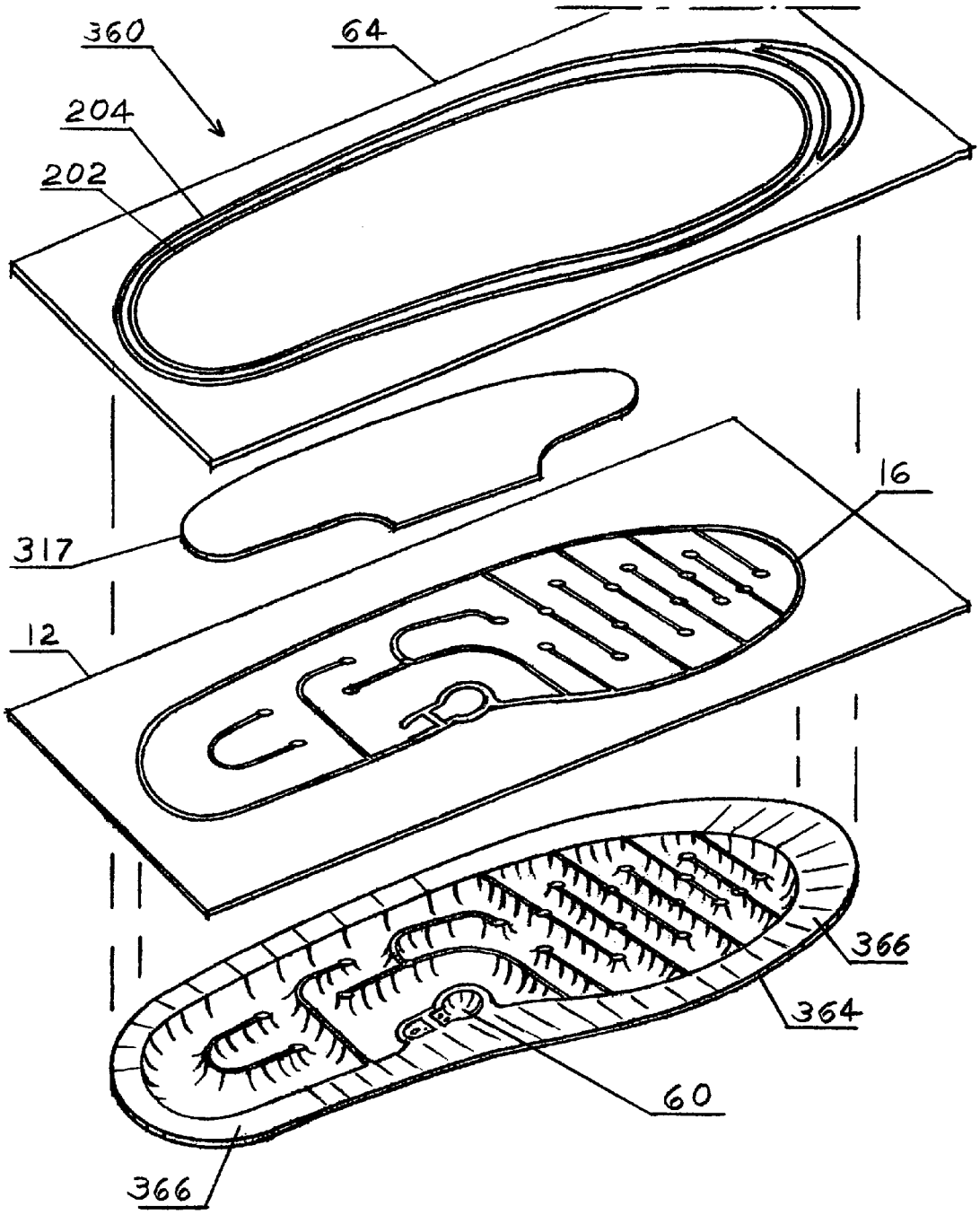
FIG. 21 is an exploded perspective view of an alternative insole and its components.

FIG. 21 is an exploded perspective view of an inner sole 360. Inner sole 360 is similar to the inner soles shown and described with regard to FIGS. 1-19. However, the inner sole 360 may be different in a non-inflated condition. Relatedly, the inner sole 360 is produced by a materially different method. To produce the inner sole 360 a bottom part 364 is prefabricated such as by molding. The pump and relief valve assembly 60 may be integrally molded with the bottom part 364. The second sheet 12, may be flat as described with regard to FIGS. 1-20, or the second sheet can be molded similar to the bottom part. A foamy arch and heel support insert 317 and the outer layer 64 may also be molded.

The inner sole 360 may also be produced in two or three sealing steps. Advantageously, the steps of inflating, overlapping, holding, and placing slits described with regard to FIGS. 13-20 can be eliminated. A first sealing step may include welding or sealing the pump and relief valve assembly 60 to the molded bottom part 364, although they can be molded together. The bottom part 364 can be made in any of many shapes and forms. In the embodiment shown in FIG. 21, a premolded bottom part 364 may be shaped from a mold cast from an inflated bottom part or sheet 14 of the embodiment of FIGS. 1-19 with recesses 62 for the pump and relief valve assembly 60 already provided. Alternatively, the premolded bottom part 364 may be formed in other ways. The bottom part 364 may have substantially permanently raised portions for forming discontinuous internal seams. A corresponding outline of seams is also shown above on sheet 12. Thus, it can be seen how the raised portions and a peripheral flange 366 on a same level will meet the corresponding outline of seams during sealing. As shown, the sealing process will leave cavities between the raised portions.

A second sealing step includes welding the second sheet 12, which may be flat, to the bottom part 364 through predetermined internal and peripheral seams shown outlined on sheet 12 as explained above. The second step of sealing forms a bladder 362 as shown in FIG. 23. The bladder 362 thus forms a functional inflatable insole and is a building platform to which may be added different accessories including one or more of the foamy insert 317 as an additional arch and heel support and the custom made insert 318 shown in FIG. 22.

The arch and heel support insert or foamy insert 317 may be positioned on top of the bladder 362 before the outer layer 64 is positioned over bladder 362 and sealed to it with peripheral seals 202 and 204.

A third and final sealing step may include welding the outer layer 64 to the bladder 362 with peripheral seams 202 and 204 forming an additional upper chamber 338. The outer layer 64 can also be prefabricated and molded with contours for a heel, arch and metatarsal portion of the foot. By integrally molding the pump together with the bottom part 364, the first of these steps can be eliminated for an even simpler method of forming the insole. This method may thus include only two of the three steps described above.

Figure 22:
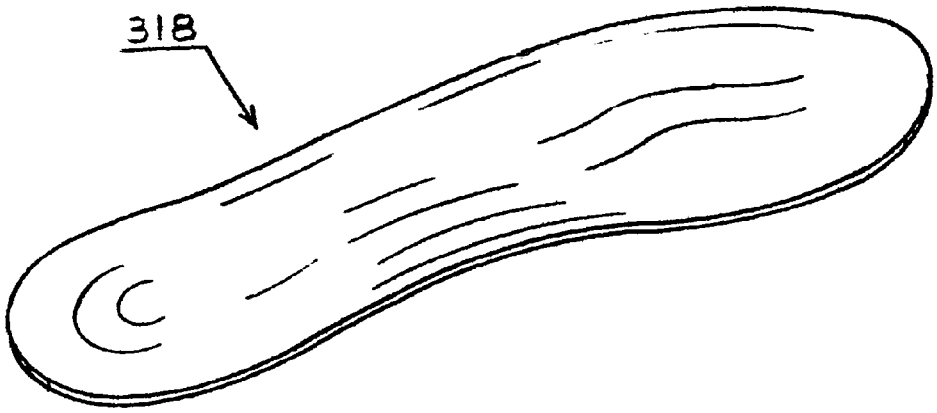
FIG. 22 is a perspective view of a custom made insert which may be incorporated in the insole shown in FIG. 23.
Figure 23:
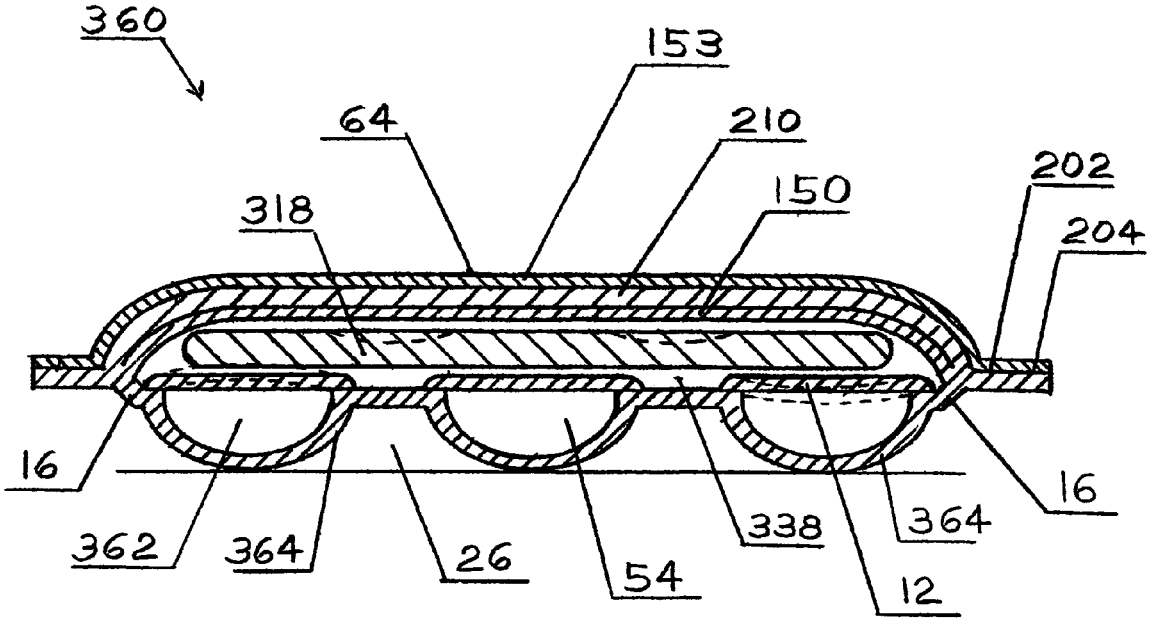
FIG. 23 is an enlarged sectional view of a portion of the insole of FIGS. 21-29 showing the construction thereof.

FIG. 22 is a perspective view of an alternative custom made insert 318. This insert 318 can be custom made in podiatrist's office or other facility for a particular patient or customer. The insert 318 may then be laid on top of already formed bladder 362. The insert 318 can be encapsulated between the outer layer 64 and a second sheet as previously explained or the insert 318 can be glued or sealed as a top layer on the inflated bladder 362 with or without an outer layer 64 applied.

FIG. 23 is enlarged typical cross section of the assembly 360 illustrated in FIGS. 21-22. On an upper surface of the insert 318, contours may be provided, as shown by dashed lines in insert 318. Also, on an upper surface of the enclosure 362, one or two peripheral chambers may be formed by sealing one or more sheets to the bottom part 364. The one or more sheets may be concave or convex as indicated by the dashed lines in FIG. 23. The level of inflation results in the concave up, flat, or concave down configurations and corresponding performance relevant to the description in FIGS. 25-29 below.

Figure 24:
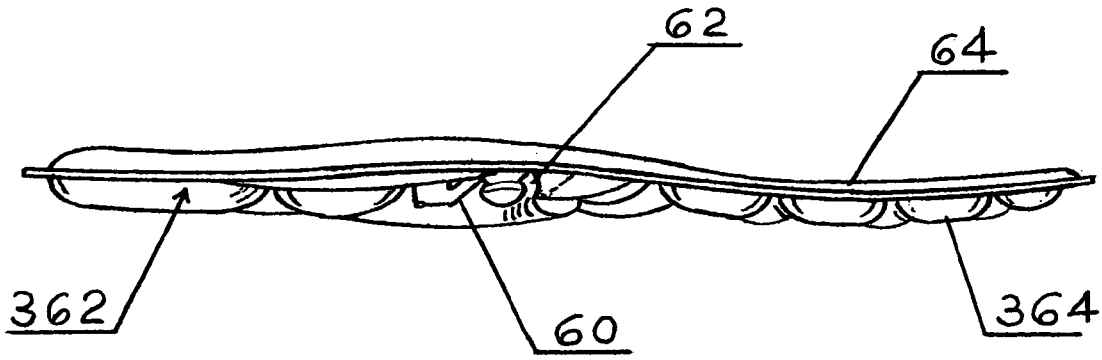
FIG. 24 is a medial (laterally inner) side view of the insole of FIGS. 21-23.

FIG. 24 is a side view of the inner sole 360 of FIGS. 21-23 from an inside position relative to a user's foot. FIG. 24 shows the bladder 362, the outer layer 64, the pump and relief valve assembly 60, and the formed recess 62. As may be appreciated, the recess 62 may be formed at least in part by the molded lower part 364.

Figure 25:
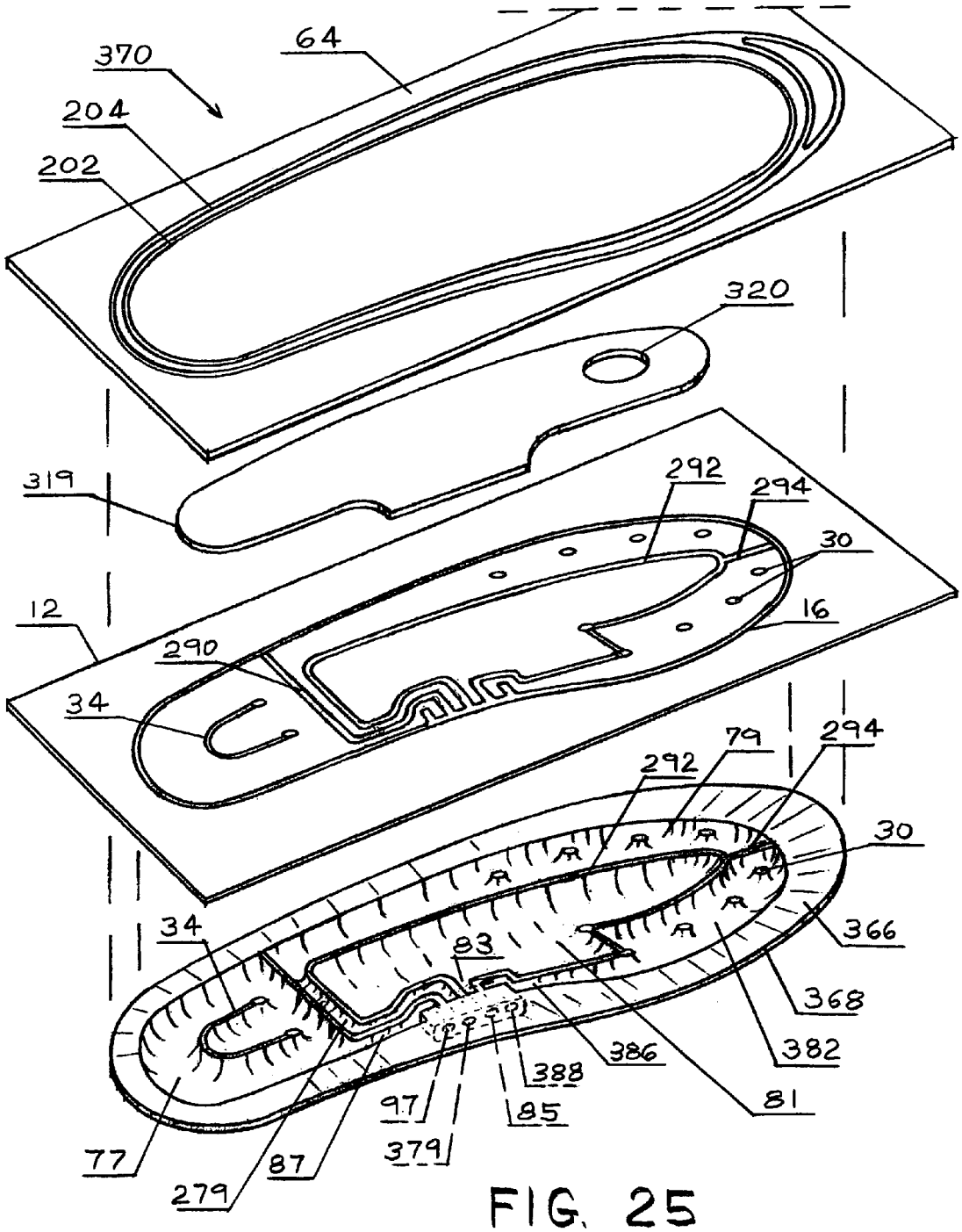
FIG. 25 is an exploded perspective view similar to FIG. 21 of an insole having an alternative configuration.

FIG. 25 is an exploded perspective view of another alternative embodiment of an inner sole 370. This inner sole 370 is very similar to the inner soles described with regard to FIGS. 21-24. However, the inner sole 370 has four separate chambers which may be fluidly connected with an exterior by relevant connectors/valves and relief valves. These connectors, valves and relief valves may be strategically located under a wearer's arch area, in a recess surrounded by an arch pillow as described above. The inner sole 370 may have a prefabricated molded bottom part 368 with a flange 366. After a sheet 12 is sealed on a top of the bottom part 368 by a die which has sealing areas corresponding to the outlined portions on sheet 12 and the bottom part 368. A configuration of the innersole 370 may include a heel chamber 77 connected by a passageway 87 to the connector and relief valve assembly 97. Similarly, an arch and forefoot chamber 81 may be connected by a passageway 83 to the connector and relief valve assembly 85. A forefoot lateral chamber 79 may be connected by a passageway 279 to the connector and relief valve assembly 379. A forefoot medial chamber 382 may be connected by a passageway 386 to the connector and relief valve assembly 388. A sealing pattern may also include circular seams 30 and a heel seam 34. A peripheral seam 16 and internal seams 290, 292 and 294 provide the internal chambers and passageways.

A foamy insert 319 may be included for arch and heel support. This insert 319 may include a hole 320 to provide an additional indentation under the outer layer 64 in an area where it may be needed by a patient. For example, if the patient has a lump or growth on his or her foot, such as a plantar fascia, and does not want to undergo risky surgery then a hole such as hole 320 may provide relief from pressure that the patient may otherwise experience. There are a variety of physical aberrations or injuries that may warrant placement of an insert having a recess to accommodate a protruberance of the user's foot. For example, a recess may be positioned to accommodate the natural position for a toe of a patient with "hammer-toe".

Figure 26:
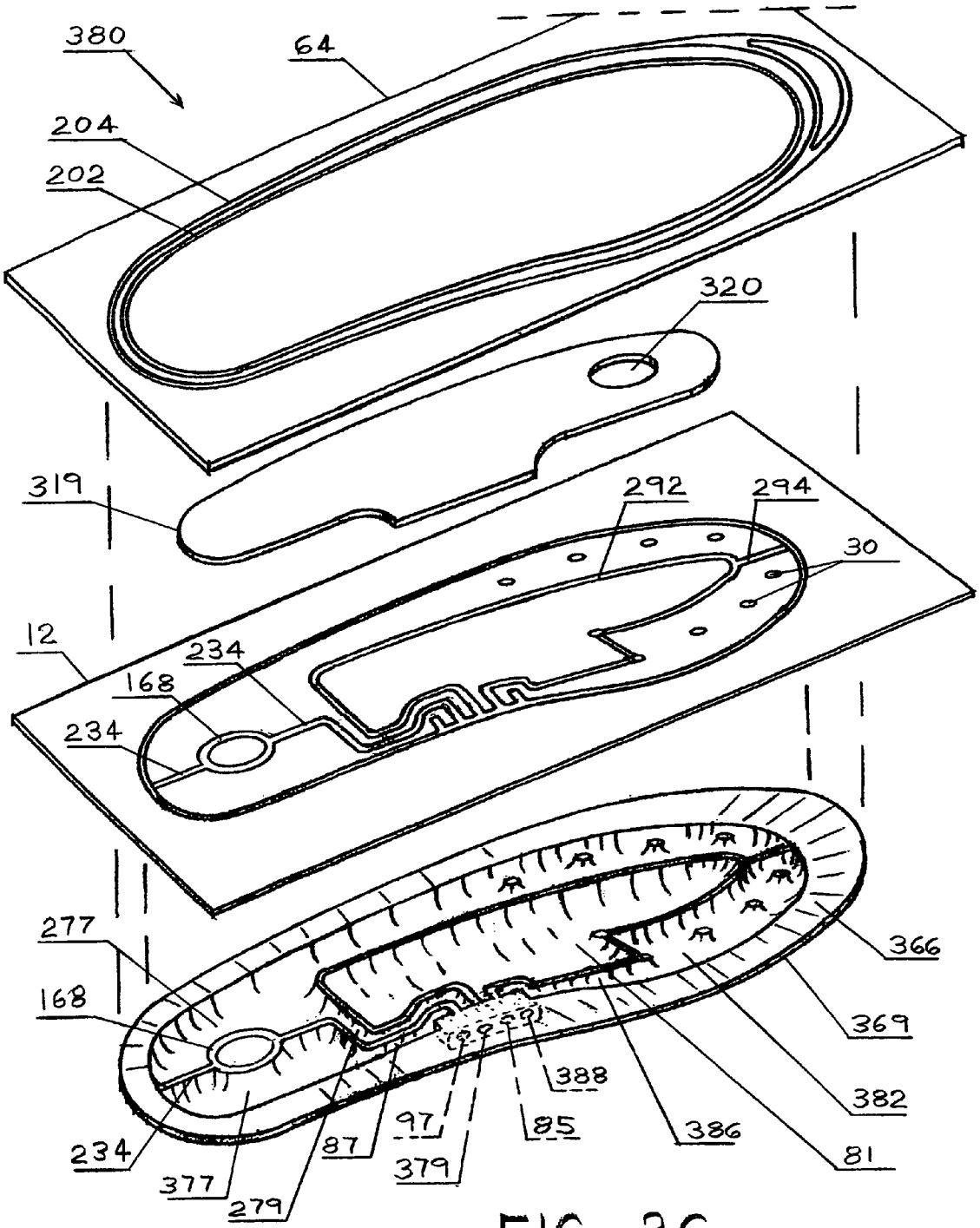
FIG. 26 is an exploded perspective view similar to FIGS. 21 and 25 of an insole having a further alternative configuration.

FIG. 26 is also an exploded perspective view of an alternative embodiment of an inner sole 380. The inner sole 380 is very similar to the insoles shown and described with regard to FIGS. 21-25. However, the seal 290 of FIG. 25 may be replaced by a combination of seals 234 and 168 which divide the heel chamber into two chambers. One of the chambers is a laterally outward chamber 277 and the other of the chambers is a laterally inward or medial chamber 377. Also a "C" shaped heel seam 34 shown in FIG. 25 may be replaced by a circular seam 168 to provide an indentation for a heel under the outer layer 64.

In accordance with the embodiments having a plurality of separately inflatable chambers, it is to be understood that the chambers may be selectively inflated to a greater or lesser degree independent of each other. Thus, a user or a physician can make the insole thicker and/or firmer in selected areas of the insole. In this way, the user or physician can therapeutically adjust the insole to treat specific conditions, including but not limited to, pronation and supination. Any of a variety of combinations of inflated chambers may be implemented. The number of chambers may vary from one to three of four. Alternatively, the inner sole may include additional independent chambers that are independently inflatable and deflatable. A multi-chamber insole or an insole with one or more chambers may also be used to increase comfort due to physical conditions or injuries.

Methods of the present invention includes enabling wearers to adjust a firmness of an inner sole according their weight and activities including but not limited to standing, walking, running, sports, etc.

A method of making the present invention may include simplified production steps which may include formation and/or use of prefabricated parts as shown in FIGS. 21-24. In particular, since the pump components may be integrally molded together with the first and/or second layers, tedious steps of placing and/or assembling the pump may be avoided. A mold for prefabricating one or both sheets may be formed by using an inflated inner sole that has been assembled from flat sheets and a separate pump. That is, an inflated inner sole may be used as a form for creating a mold that will thereafter be used to prefabricate a prefabricated contoured inner sole.

As may be appreciated, the method of making may include one or more sealing steps. For example, a first sealing step for inflatable inner soles that do not have an integral pump may require a preliminary step of placing pumps with flanges up in a recess of a bottom plate of a die. Then the pump and printed matter may be heat sealed on the bottom or first sheet. Next a second sheet may be placed on the first sheet and heat sealed in a second sealing step. Subsequently, an inflatable enclosure formed by the first and second sealing steps may be inflated. This will result in the inflatable inner sole being urged toward a kidney shape when the seams are configured as shown in the figures of the present application. Thus, the overlying and underlying portions described above will naturally overlap each other. The portions can be overlapped even more than they naturally are and stapled or otherwise fastened to each other. A third sealing step may be performed by placing a third sheet over the inflated enclosure and sealing the third sheet to the inflated enclosure. The third step may be performed while the portions are overlapped and the inflatable enclosure has been inflated. The third sheet may be an outer layer as has been described above. The third sheet may be sealed only on a periphery. It is to be understood that the outer layer may include a fabric, a foam, and a polyurethane film of which the foam and polyurethane film become fused or integrally connected with the first and second sheets during the third sealing step. After the sealing steps, the inner sole may be cut in close proximity to or on one of the outer peripheral seams. It is to be understood that the bottom plate of the die may have any contour to accommodate a contour of the first or lower sheet and/or inflation system. For example, if the first or bottom sheet is prefabricated with a contour, then the bottom plate of the die will be configured to accommodate the contour. Likewise, a top plate of the die may be recessed or contoured to accommodate a contour of the upper or second sheet. The top and bottom plates will have raised portions for forming the seams in a respective one of the sealing steps. It is to be understood that different plates (tools) may be used for different sealing steps. Also, the raised portions on the plates should be positioned so that the seams and outer peripheral flange will be formed in the same general plane.

There are several advantages associated with the method of making the present invention. These advantages include simplified production steps which may include formation and/or use of prefabricated parts. The method of forming or using prefabricated part(s) provides chambers and channels or passageways that connect the chambers to inflation mechanisms in a simplified way that requires fewer steps. In embodiments utilizing the prefabricated and non-prefabricated parts, a plurality of chambers in an insole may be connected to respective inflation mechanisms of the inflation system. This configuration enables a user to adjust gas pressures in different chambers within the insole to provide different firmnesses and/or thicknesses in different areas of the insole. In particular, the bottom and/or top parts may be formed to provide laterally outer, inner, medial, heel, toe, or other intermediate chambers, for example. This aspect of the invention enables a podiatrist to more easily treat foot problems like pronation and supination by inflating portions of the inner sole to counter the physical tendencies of the user. That is for example, an arch area may be inflated to a greater extent to treat a pronation or a fallen arch. Laterally outward portions of the inner soles may be inflated to a greater pressure or extent to treat supination or a patient having bowed legs.

Also, the method includes strategically positioning inflation mechanisms including one or more of pumps, connectors and relief valves, under a wearer's arch area, in a recess which may be formed in part by a "C" shaped arch pillow. On the other hand, the recess may also be formed by placement of slits in sheet material or by forming the recess during molding. As shown, the recess may extend out of the plane defined by the intersection of a majority of an upper and a lower sheet of material or an upper sheet and a bottom part made during sealing formation of the bladders.

In accordance with method of the present invention, the inflatable inner sole may be held in a contoured state by sealing a third sheet to the first and second sheets while the inflatable enclosure formed between the first and second sheets is inflated. In this way, the structure forming the recess that extends out of the plane generally defined by the intersection between the first and second sheets is held in place once the third sheet is attached to the first and second sheets.

Figure 27:
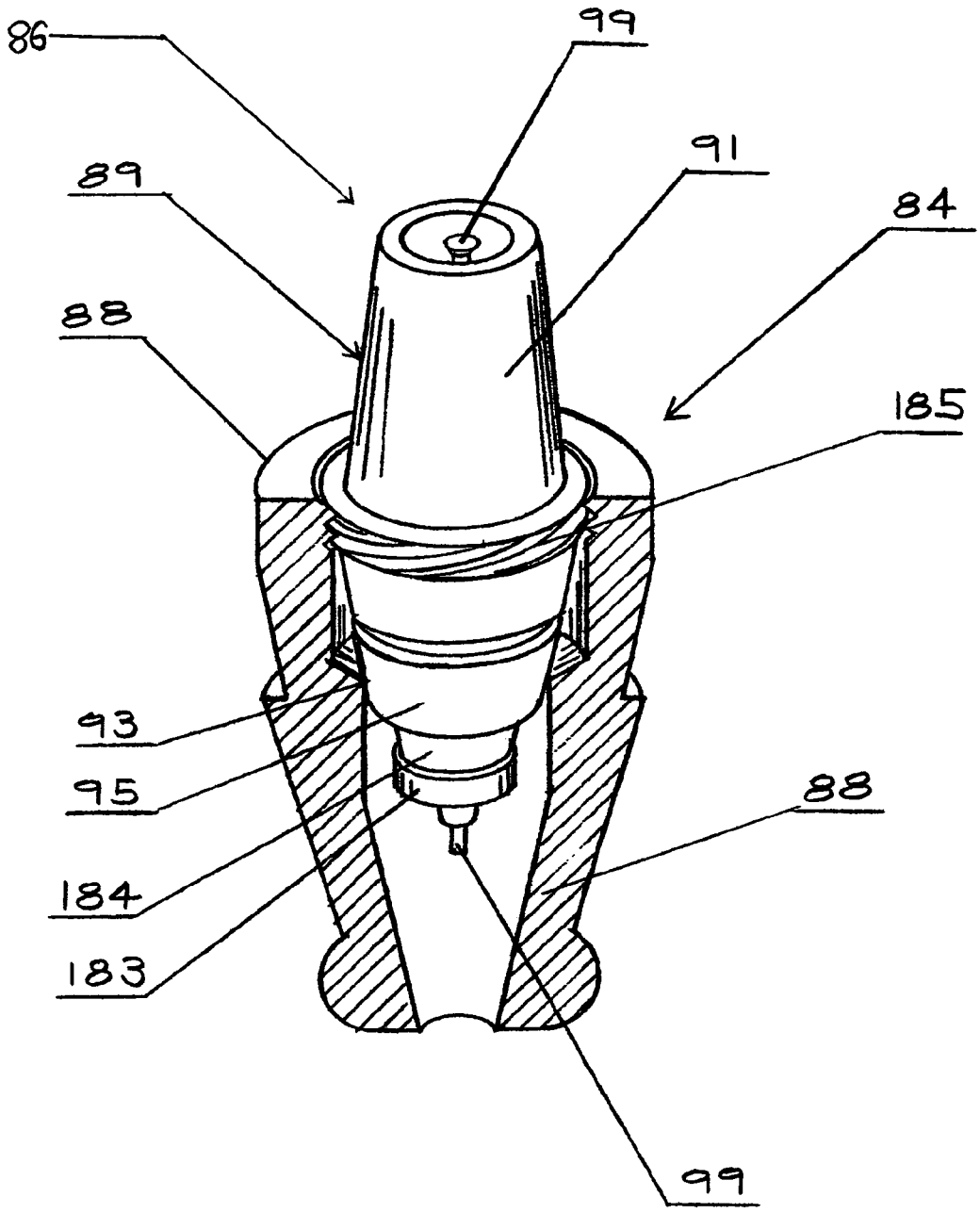
FIG. 27 is a partial sectional view of a connector and relief valve that may be incorporated with the embodiments of FIGS. 25 and 26.

FIG. 27 is a sectional view of the connector/valve assembly 84 which may form part of the valve assembly 86. The connector/valve 89 may be a conventional inflation valve similar to valves available from Schrader Automotive Inc., Nashville, Tenn. 37202. The valve 89 may have a valve member 183 resiliently biased into a closed position against a valve seat 184 by an internal spring (not shown). The valve member 183 may be secured to a rod 99 which extends through the valve 89 to an upper end which serves as a valve operator to permit opening of the valve. The valve 89 may have external threads 185 which may be threadably received within a connector housing 88. The upper end of a neck 91 of the valve 89 may be conical to permit removable attachment of an inflation device such as an external pump. The lower end of valve 89 may have a rubber ring 95 which seats against an internal edge 93 of the housing 88 to which provide air tight connection.

Figure 28:
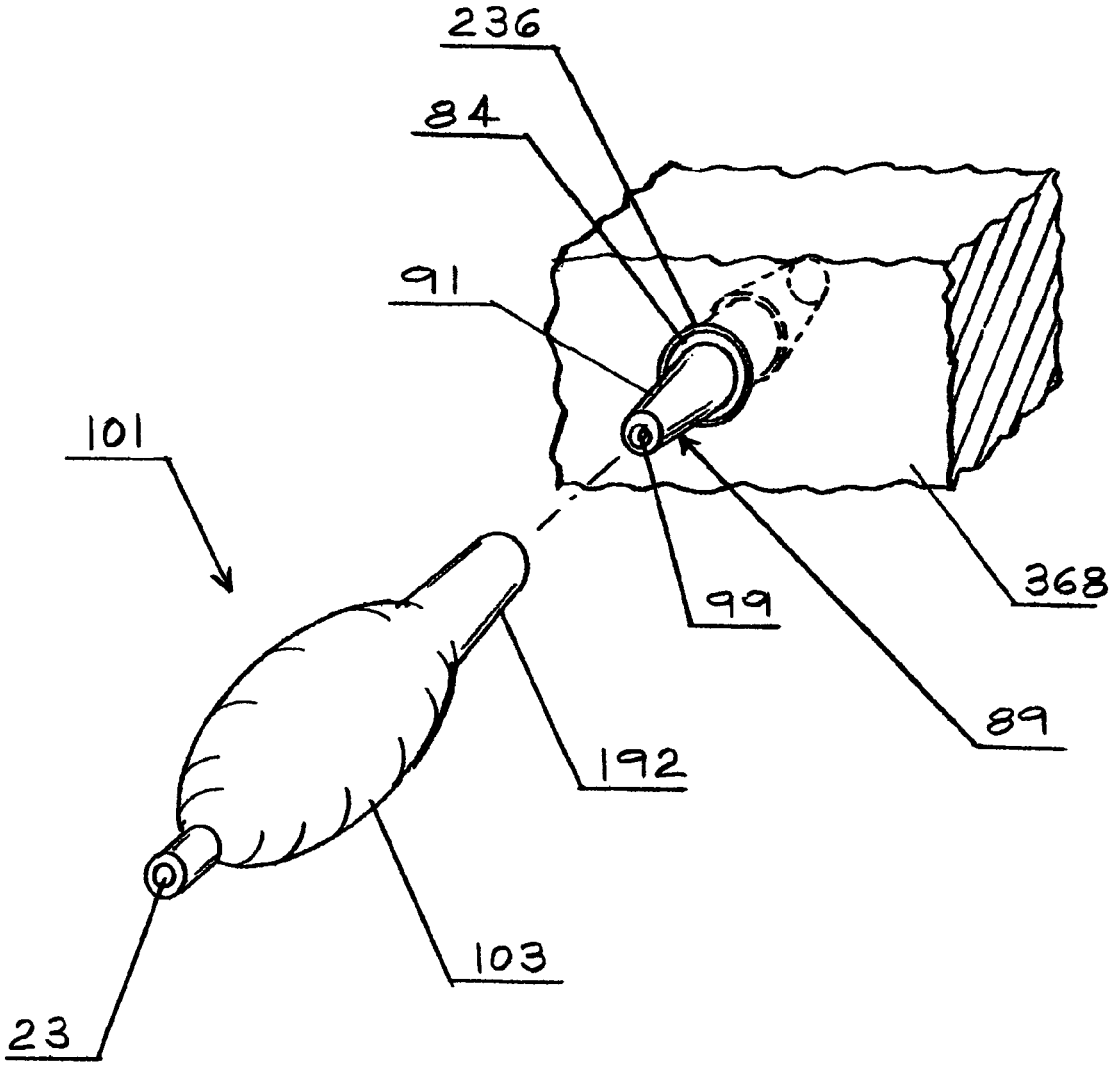
FIG. 28 is an enlarged perspective view of an external pump that may be used to inflate enclosures in the embodiments of FIGS. 25-27.

FIG. 28 is an enlarged perspective view of an external air pump 101 and the valve 89. A flexible bulb 103 may have an inlet check valve 23 inserted into one end of flexible bulb 103. The opposite end of the flexible bulb may have a port 192 which slides onto an outer surface of neck 91 of the valve 89 shown in greater detail in FIG. 27. The flexible bulb 103 may be easily removed in order for the valve 89 to be used to release air from any particular chamber as shown in FIGS. 25 and 26. Outer surface of neck 91 may have external threads which may be threadably received within the port 192 for better fit and faster removal of the pump 101. Also, in the exemplary view of FIG. 28 an opening 236 is shown on a side of the bottom part 368. Thus, the apparent openings at 85, 97, 379, and 388 may receive valves 89 similar to that which is shown in FIGS. 25 and 26. Although valve 89 is shown and described to explain a function of the process of inflation and deflation, this valve 89 could be replaced by an inexpensive conventional football valve.

Figure 29:
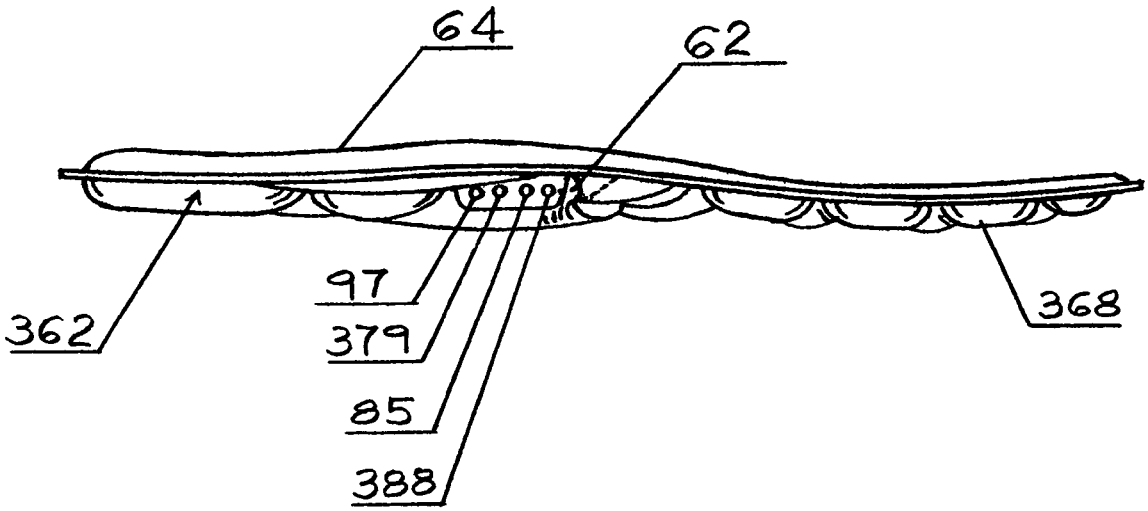
FIG. 29 is a laterally inner side view of the insole of FIGS. 25-28.

FIG. 29 is a side view of the inner sole shown in FIG. 25. FIG. 29 also shows the bladder 362, the outer layer 64, the connectors/valve assembles 97, 379, 85, 388, and preformed recess 62. FIG. 29 also shows the molded bottom part 368.

Figure 30:
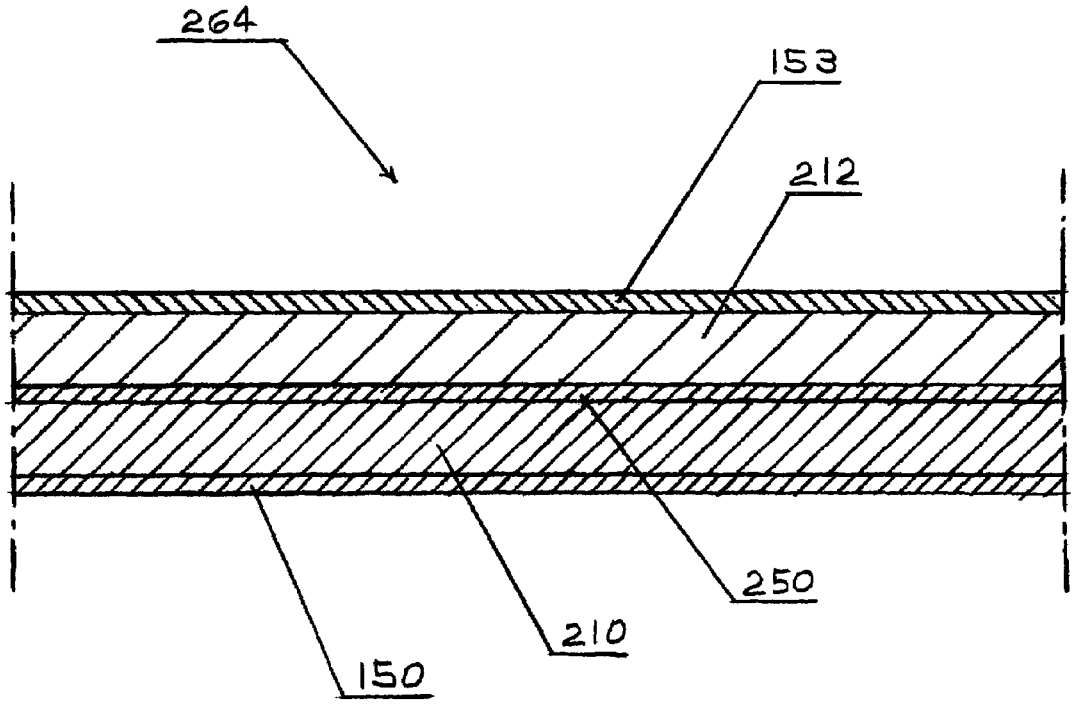
FIG. 30 is an enlarged sectional view of an alternative outer layer.

FIG. 30 is a sectional view similar to FIG. 6 of an alternative embodiment of an outer layer 264. However, the outer layer 264 has additional layers of material including a thermoplastic film 250 and a low density foam 212. The outer layer may incorporate the same high density foam layer 210 and the thermoplastic film 150 similar to the outer layer of FIG. 6. In the embodiment of FIG. 30, the outer layer 264 may have the additional thermoplastic film 250 on top of the high density foam 210. The low density 212 foam may be laminated on top of the upper layer of thermoplastic film 250. An advantage of providing thermoplastic films 150 and 250 above and below the high density foam is that they inhibit cracking of the high density foam when the high density foam is sandwiched between them. The high density foam 210 adds sturdiness and durability. The additional low density foam 212 provides improved comfort and conforms well to a user's foot. As described above, the outer layer may have a fabric material 153 between the outer layer and the user's foot. In this embodiment, the fabric 153 may be attached to the low density foam 212 such as by laminating.

As shown in FIG. 30 the outer layer 264 may be used to form the upper chamber 138 described with regard to FIGS. 6 and 7 above. As described above, to form the outer layer, the outer layer 264 may be laminated with a thermoplastic film 150 on a bottom and a relatively high density thermoplastic foam 210 in a middle of the outer layer 264. The other thermoplastic film 250 may be laminated on a top of the high density thermoplastic foam 210. Thus, thermoplastic films 150, 250 inhibit formation of the cracks on the outer layer 64, and especially at areas above seams on the enclosure 11. The outer layer 264 can include foamy thermoplastic materials with any of a variety of different thicknesses and densities.

It is to be understood that features of the various embodiments shown and described herein may be incorporated in any combination desired without departing from the spirit and scope of the invention. It is to be understood that while various aspects of the present invention have been described in terms of inflation by air, other gases or materials could be used to inflate or included within the enclosures or chambers without departing from the spirit and scope of the invention. These gases or materials may include known gases, fluids, or particulate material that may behave like a fluid.

It is contemplated that the general structure shown throughout the figures may be formed in other manners than those specifically set forth above. For example, upper and lower complimentary parts could be molded or otherwise prefabricated to form a generally clam shell arrangement that does not require inflation to assume the shape, size, and contour shown in the Figures. The upper and lower molded parts could be bonded together at the peripheries and/or elsewhere to sealingly form at least one enclosure between the parts. The bond may be provided by fusing or heat sealing. Thus, such an arrangement could be made to receive air or other gas in enclosures within and/or between the complimentary parts. In this way, the firmness and other support and comfort characteristics may be adjusted by adding or removing air or other fluid. As set forth above, air, gel, or a combination of air and gel may be used to fill or partially fill the enclosures. The invention has been described with reference to the illustrated and presently preferred embodiment. It is not intended that the invention be unduly limited by this disclosure of the preferred embodiment but instead by the elements and their equivalents set forth in the claims that will follow.

The invention claimed is:

1. An inflatable inner sole comprising:

at least a first sheet and a second sheet sealed together along a continuous seam lying generally in a plane and forming an inflatable enclosure;

an inflation system fluidly connected to an interior and an exterior of the inflatable enclosure; and a medial recess formed by at least a portion of the first and second sheets, a base of the medial recess extending out of the plane, and at least a portion of the inflation system disposed within the medial recess.

2. The inflatable inner sole of claim 1, further comprising a pressure gauge fluidly connected to the interior of the inflatable enclosure, wherein the pressure gauge includes a generally see-through tube and a movable diaphragm in the see-through tube.

3. The inflatable inner sole of claim 1, wherein the inflation system comprises a pressure relief valve, the pressure relief valve having a sleeve for surrounding a spring loaded valve stem, the sleeve further comprising a radially inwardly extending spring seat flange.

4. The inflatable inner sole of claim 1, wherein at least one of the sheets comprises a prefabricated molded sheet having a predetermined contour forming passageways for air within the interior of the enclosure of the inflatable inner sole, the prefabricated molded sheet further comprising at least a portion of the inflation system, wherein the portion of the inflation system is formed as one piece together with a remaining portion of the prefabricated molded sheet.

5. The inflatable inner sole of claim 4, wherein the inflation system comprises a pump.

6. The inflatable inner sole of claim 1, wherein:

the inflatable enclosure further comprises a plurality of independent chambers connected to respective inflation mechanisms of the inflation system;

the plurality of independent chambers are independently adjustable by selectively adding or removing a gas from within the chambers.

7. The inflatable inner sole of claim 6, further comprising passageways formed integrally with at least one of the first and second sheets, the passageways fluidly connecting the plurality of independent chambers to the inflation mechanisms.

8. The inflatable inner sole of claim 1, further comprising:

a third sheet sealed to at least one of the first and second sheets; and an insert disposed between the third sheet and the at least one of the first and second sheets.

* * * * *